US005365993A

United States Patent [19]

Jellá

[11] Patent Number: 5,365,993

[45] Date of Patent: Nov. 22, 1994

[54] SECTIONAL DOOR

[76] Inventor: John F. Jellá, 1949 E. Carver, Tempe, Ariz. 85282

[21] Appl. No.: 724,212

[22] Filed: Jul. 1, 1991

Related U.S. Application Data

[63] Continuation-in-part of Ser. No. 492,771, Mar. 12, 1990, abandoned, which is a continuation-in-part of Ser. No. 236,548, Aug. 25, 1988, abandoned.

[51] Int. Cl.[5] ..... E05D 15/06

[52] U.S. Cl. ..... 160/201; 160/232

[58] Field of Search ..... 160/201, 188, 189, 133, 160/274, 229.1, 232

[56] References Cited

U.S. PATENT DOCUMENTS

| | | | |
|---|---|---|---|
| 2,391,845 | 12/1945 | Rowe | 160/201 |
| 3,056,451 | 10/1962 | Federline et al. | 160/201 |
| 3,347,305 | 10/1967 | Urbanick | 160/201 X |
| 4,532,973 | 8/1985 | DeFalco | 160/201 X |
| 4,860,813 | 8/1989 | Ballyns et al. | 160/201 X |
| 4,924,932 | 5/1990 | Esnault | 160/201 |

*Primary Examiner*—David M. Purol
*Attorney, Agent, or Firm*—Jordan M. Meschkow; Lowell W. Gresham; Don J. Flickinger

[57] ABSTRACT

A base member and a fascia are assembled to form a hollow door section which is filled with insulative material. Adjacent sections are coupled along respective longitudinal edges for angular and spatial displacement. The base member is extended from a selected plastic with male and female coupling components extending continuously along respective longitudinal edges. A plurality of mounting members projecting from the lateral edges of the sections matingly and slidably engage the semi-cylindrical guide surface of a tract for reciprocal vertical movement of the door. The door may be partially raised for spatial displacement of the sections whereby flow-through ventilation openings are exposed. In a specific embodiment, a flexible drive screw is rotatably carried within the track for powered operation of the door.

6 Claims, 10 Drawing Sheets

FIG. 1
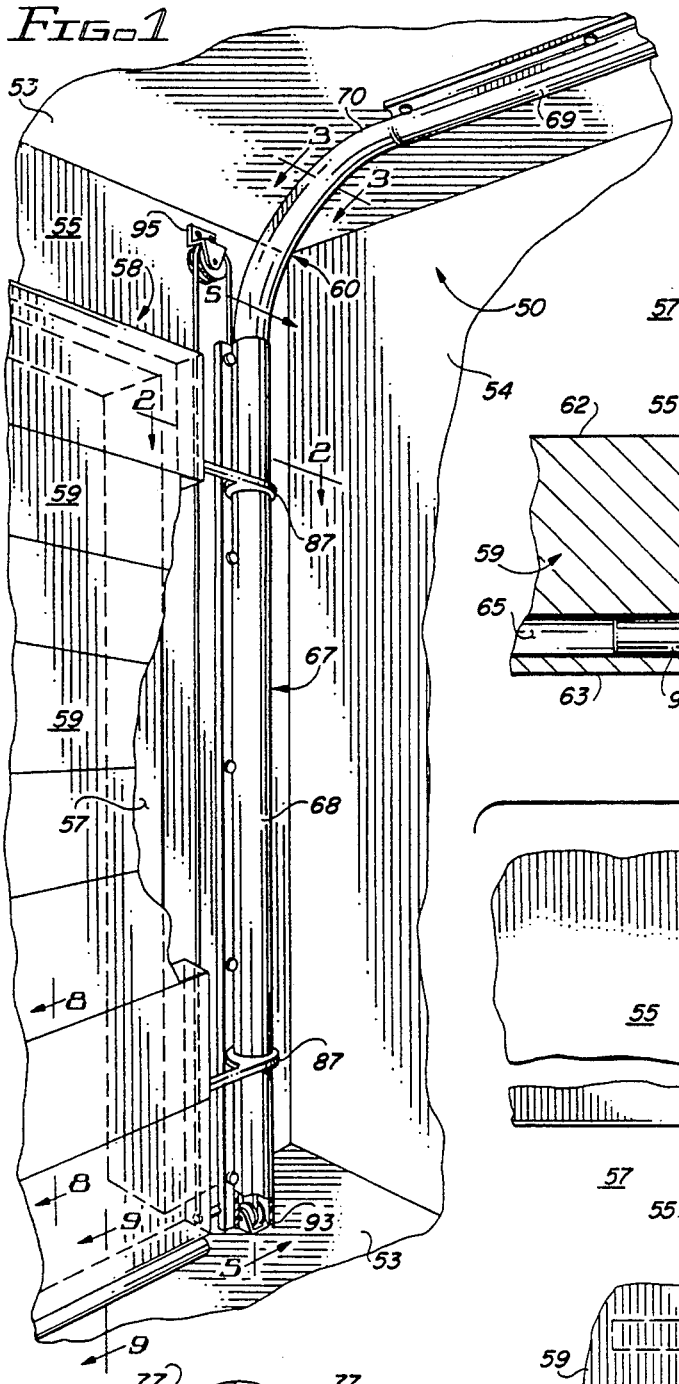
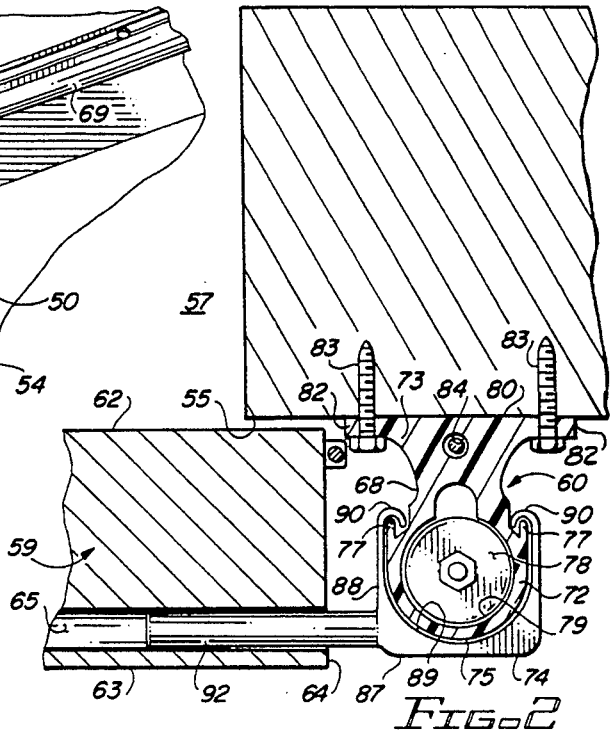
FIG. 2
FIG. 4
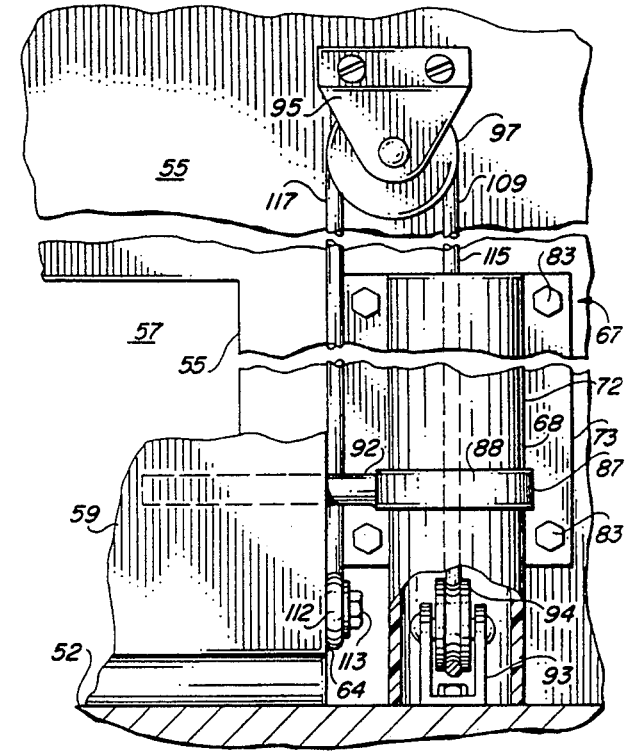
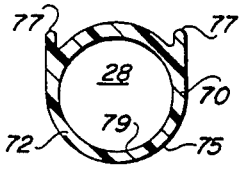
FIG. 3

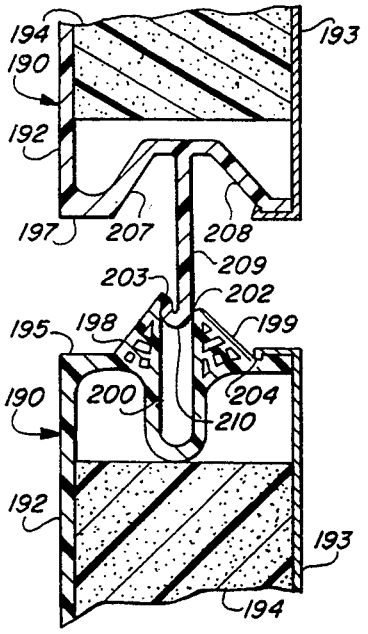
FIG. 12
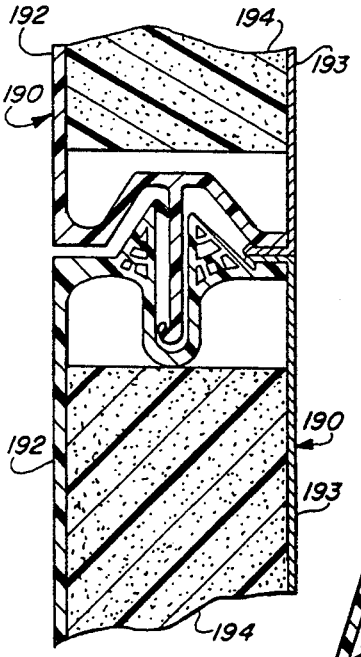
FIG. 11
FIG. 10
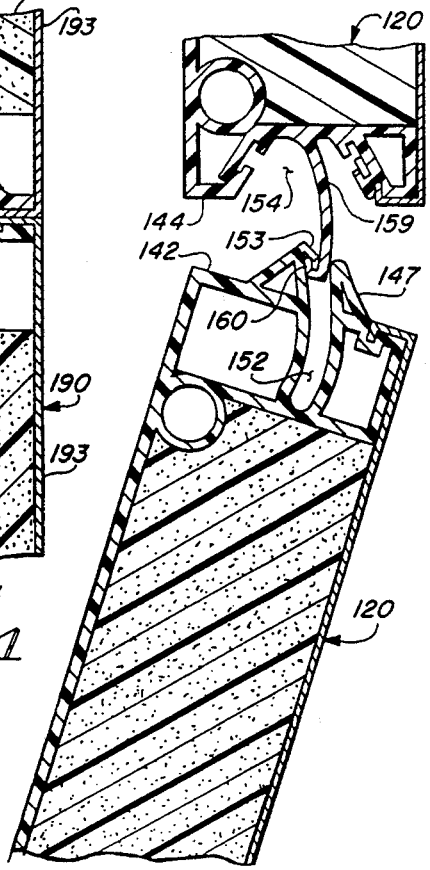
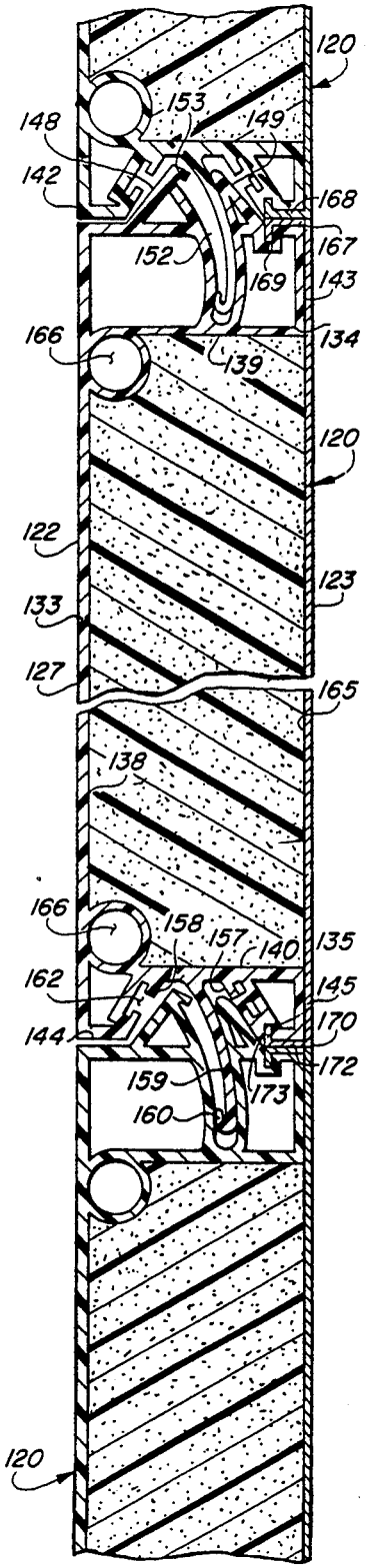
FIG. 8

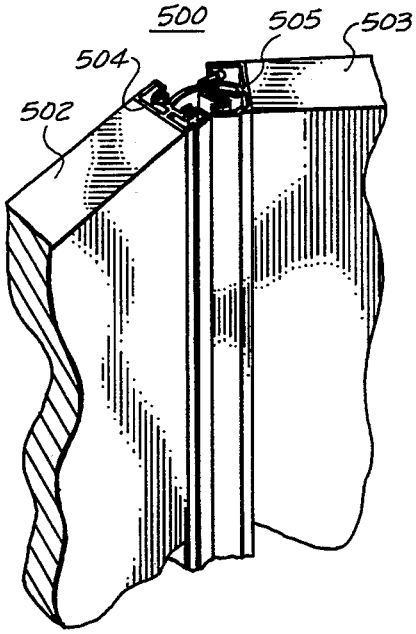
FIG. 28
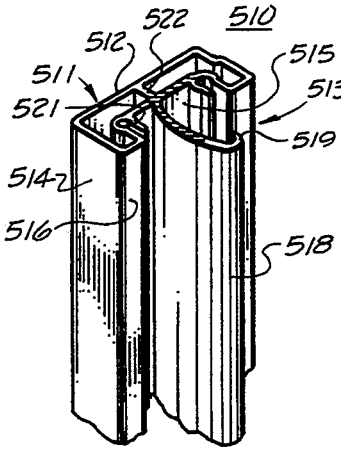
FIG. 29
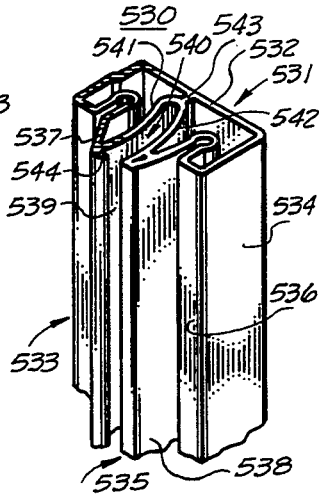
FIG. 30
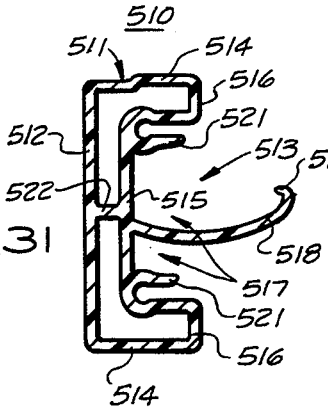
FIG. 31
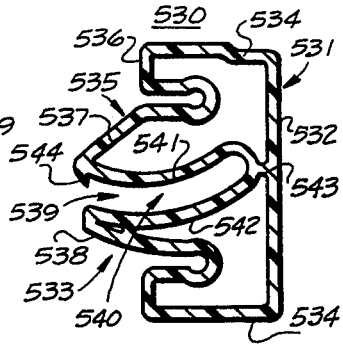
FIG. 32
FIG. 33
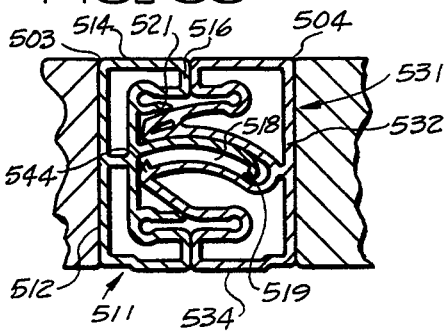
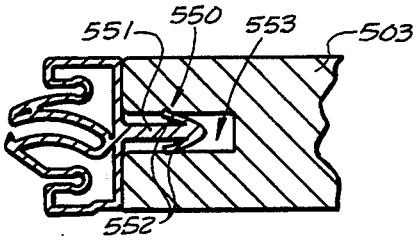
FIG. 35
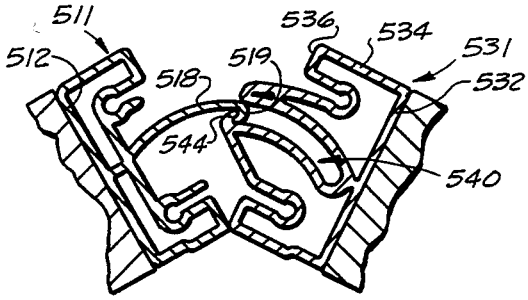
FIG. 34
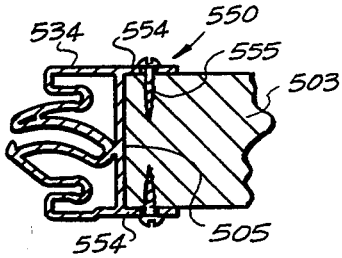
FIG. 36

FIG. 37
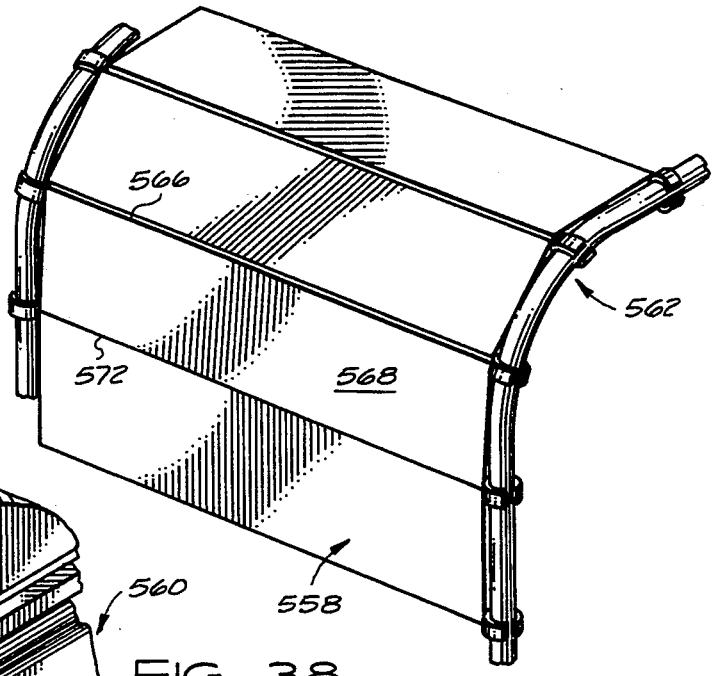
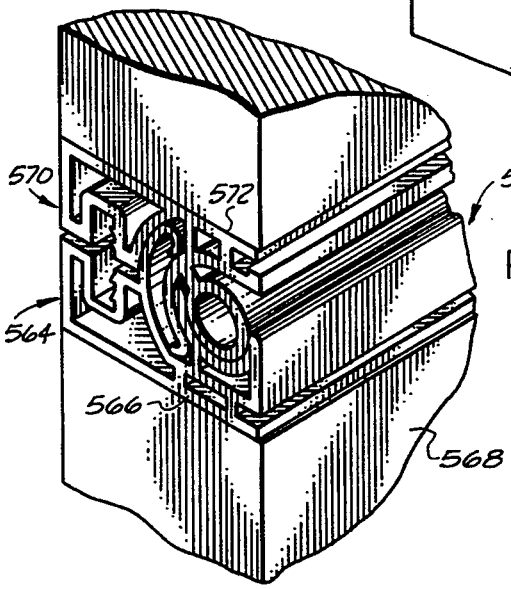
FIG. 38
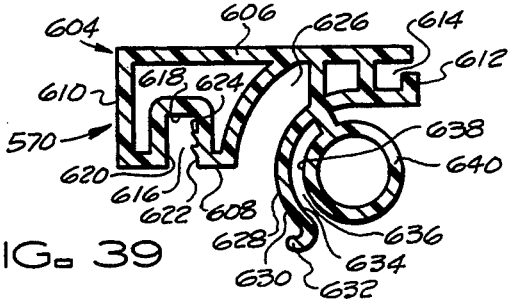
FIG. 39
FIG. 40
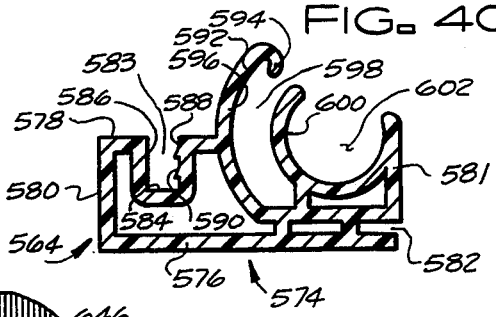
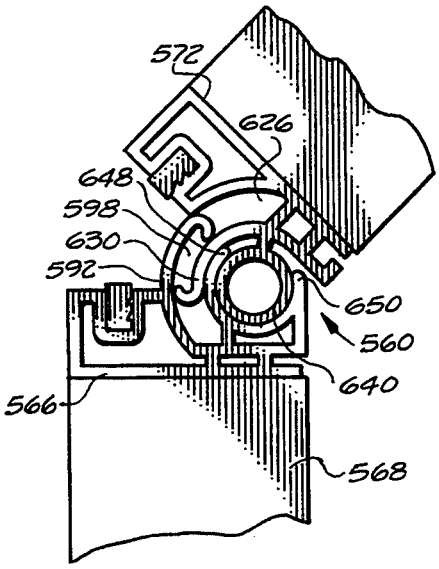
FIG. 42
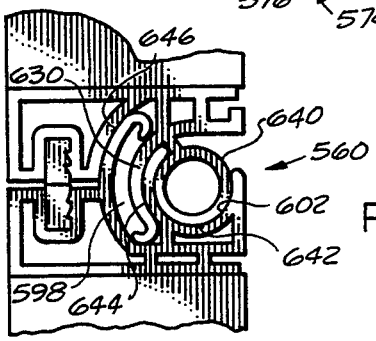
FIG. 41

FIG. 43
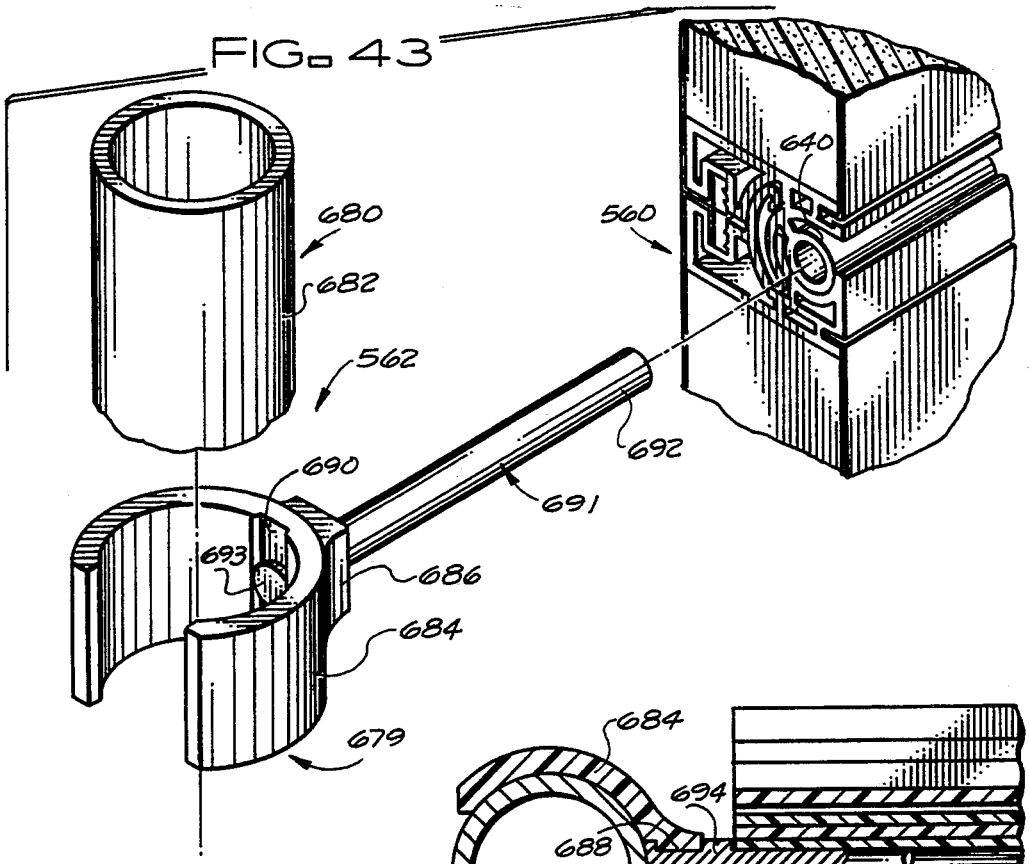
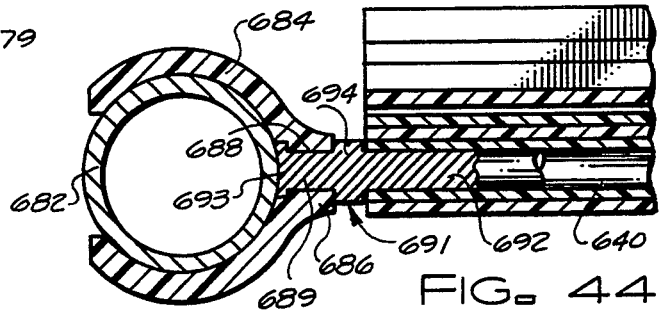
FIG. 44
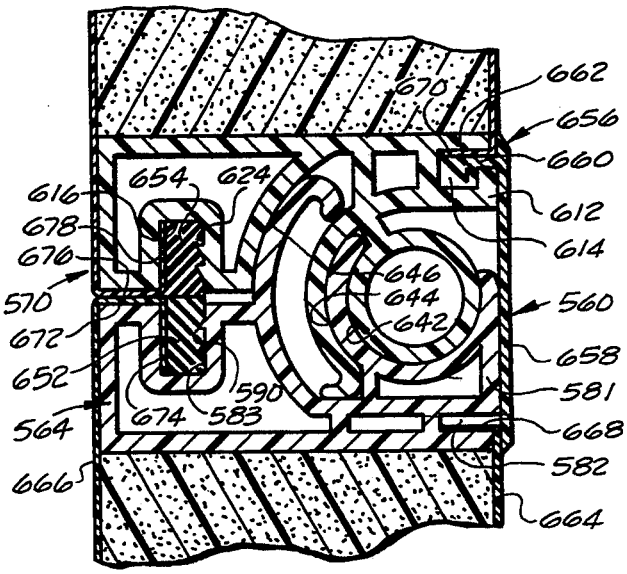
FIG. 45
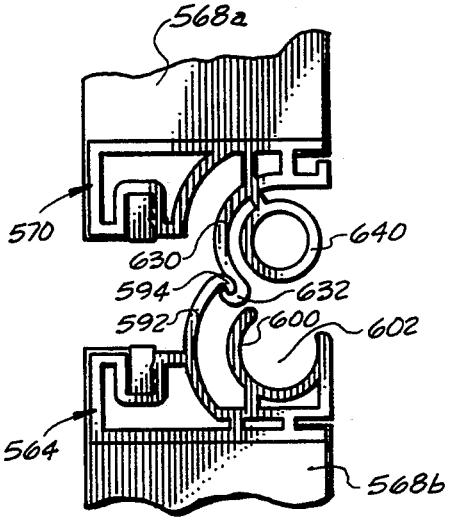
FIG. 46

SECTIONAL DOOR

CROSS-REFERENCE TO RELATED APPLICATION

This is a continuation-in-part of U.S. patent application Ser. No. 492,771, filed Mar. 12, 1990, now abandoned which is a continuation-in-part of U.S. patent application Ser. No. 236,548 filed Aug. 25, 1988, now abandoned.

BACKGROUND OF THE INVENTION

1. Field of the Invention

This invention relates to doors characterized by a plurality of hingedly coupled sections.

More particularly, the present invention relates to sectional doors of the type especially adapted for vertical movement.

In a further and more specific aspect, the instant invention concerns improvements in the structure and methods of fabrication of doors of the above description.

2. Prior Art

Sectional doors of the type disposed for vertical movement are exceedingly well-known. Exemplary is the conventional garage door commonly used in connection with single and multiple family residential structures. Doors of the immediate character also have broad application in connection with commercial facilities such as service centers and warehouses.

A sectional door commonly includes a plurality of horizontally extending, elongate sections. The several sections are vertically aligned, the lower edge of each section being hingedly affixed to the upper edge of the successive section. The ends of each section are secured to a respective guiding track on either side of a doorway. Generally, the guides extend vertically along the doorway and translate to extend horizontally at an overhead location.

Traditionally, door sections are constructed of wood or metal. Adjacent sections are joined by several pintle type hinges, the leaves of which are secured by appropriate mechanical fasteners to the rear or interior side of the sections. The tracks are usually fabricated of steel "C" channel stock with an arcuate transition intermediate the vertical and the horizontal runs. Rollers, carried upon shaves projecting from the sections, follow within the "C" channel tracks.

The door structure usually includes one or more counter balancing springs which assist in lifting and also function to dampen movement during closing. Frequently, the door is fitted with a power driven accessory device for opening and closing. Usually including a reversible electrically rotated lead screw coupled to the upper most section, the device raises and lowers the door in response to manually operable switch means.

Doors of the foregoing character have been continuously produced in substantial quantities for an extended period of time. Nevertheless, the structure has never proven to be entirely satisfactory. Especially noted are characteristics which represent conceivable safety hazards, present potential for structural failure and detract from appearance.

The hinges, the track and roller assembly, and the springs are representative of the potential for structural failure. Comparably, these items require vigilant periodic attendance for purposes of maintenance and adjustment. Also noted in this regard are accessory items such as electrically operated opening and closing devices. In general, the foregoing are causes of annoyance and inconvenience for the user. The breakage of the spring, however, can have serious effects. Considering the physical size and the stored energy, a fractured spring can propel fragments with a shrapnel-like effect upon animate and inanimate objects in the environment.

The inherent design configuration of the conventional prior art sectional door is also a source of concern. Specifically observed are the areas of thermal insulation and ventilation. The insulation value of a metal door, for example, is minimal. Further, the ever present space between the sections provides for continuous communication between the interior of the enclosure and the surrounding environment with further loss of thermal integrity and a means of ingress for airborne contaminates and particulate matter. On the other hand, the door must be at least partially raised when exterior ventilation is desired.

Another disadvantage associated with conventional prior art sectional doors is seen in the substantial cost of initial installation and of maintenance. Part of the initial cost resides in the necessity of producing and maintaining an extensive inventory in order to provide a satisfactory selection of styles for the consumer. Replacement of an entire door or even a single damaged panel is expensive. Accordingly, a door is considered a major fixture with change in decor being limited to repainting.

It would be highly advantageous, therefore, to remedy the foregoing and other deficiencies inherent in the prior art.

Accordingly, it is an object of the present invention to provide improvements for sectional doors.

Another object of the invention is the provision of a sectional door which is relatively unencumbered and free from externally attached hardware.

And another object of this invention is to provide a sectional door assembly having fewer exposed operational components.

Still another object of the invention is provision of improvements which substantially reduce the potential safety hazards normally associated with vertically moveable sectional doors.

Yet another object of the instant invention is to provide a sectional door having effectively increased thermal insulation.

Yet still another object of the invention is the provision of improved guide means for supporting a vertically moveable sectional door.

And a further object of the invention is to provide an improved sectional door assembly which is substantially more conveniently and rapidly installed than prior art devices.

Still another object of the immediate invention is the provision of improvements which greatly reduce the necessity of usual accessories, such as powered operating devices.

Yet another object of the invention is to provide improvements in the methods of fabrication of sectional doors.

And yet another object of the invention is the provision of a sectional door according to the foregoing which is less expensive to manufacture and to maintain.

SUMMARY OF THE INVENTION

Briefly, to achieve the desired objects of the instant invention in accordance with a preferred embodiment thereof, first provided are means for moveably coupling like adjacent sections of a sectional door. Included is an element of a coupling pair extending continuously along a longitudinal edge of one of the sections. A complemental element of the coupling pair extends continuously along a longitudinal edge or the adjacent panel. The element and the complemental element couple the sections for pivotal movement about a longitudinal axis between an aligned position and an angularly displaced position. In a more specific embodiment, the element is in the form of an elongate pintle member and the complemental element is in the form of a longitudinally extending, semi-circular socket for engageably and rotatably receiving the pintle member.

In an alternately preferred embodiment of the invention, the element is movable in reciprocal directions along a lateral axis relative complemental member whereby a section and an adjacent section are further coupled for movement between an adjoining position and a specially displaced position. Also provided are stop means interacting between the element and the complemental element to limit movement between the section and the adjacent section as the sections move in a direction toward the specially displaced position. Further contemplated by the invention is a member of a male/female engagement pair extending along the longitudinal edge of one of the sections and a complemental member of the female engagement pair extending along the longitudinal edge of the other of the sections. The member engages the complemental member when the sections are in the adjoining position for structural reinforcement of the door. The male/female engagement pair may also function as sealing means between adjacent sections. Further provided are ventilation means being normally closed when the sections are in the adjoining position and being opened as the sections are moved to the specially displaced position.

More specifically, the element may be in the form of a tongue and the complemental element in the form of a groove for matingly receiving the tongue. The tongue is movable in extendable and retractable directions within the groove. The tongue includes an enlarged terminal portion which is received against a lip at the opening of the groove as the sections are moved into the specially displaced position. The male/female engagement pair includes a recess extending along one of the sections and a matingly receivable projection extending along the other of the sections. The ventilation means may be in the form of passages extending through the tongue.

Further provided is a track assembly for affixing a door to a building and for reciprocal movement of the door along an upright axis. In a preferred embodiment, the track includes an elongate upright guide portion and mounting means for securing the guide portion to a wall. The embodiment also includes a guide member having a body portion which is slidably movable upon the guide portion and attachment means for securing the body portion to the door.

In a more specific embodiment, a guiding surface extends continuously along the guide portion and a guide surface slidably opposing the guiding surface is carried by the body portion of the guide member. The guiding surface may be carried externally of the guide portion and the guide surface carried internally of the body portion. Alternately, the guiding surface is carried internally of the guide portion and the guide surface is carried externally of the body portion. Further provided are retention means for captively retaining the guide member upon the track. In a specifically preferred embodiment, the guide portion is generally U-shaped in cross section, having an intermediate semi-cylindrical guiding surface and a pair of spaced apart ears extending along the guide portion in opposition to the guiding surface. The body portion includes an intermediate semi-cylindrical guide surface terminating at each end with an inwardly turned U-shaped terminal portion matingly receiving a respective one of the ears.

According to yet a further embodiment of the invention, the track assembly includes biasing means for counter balancing the weight of the door and for dampening the terminal portion of movement of the door. Specifically, the tension spring may be carried within a bore extending longitudinally within the track. Hanger means carried within the bore anchor one end of the spring. A cable unites the other end of the spring with the door.

Alternately, an elongate drive member is rotatably housed within the bore and engaged with drive means for selectively rotating the drive member in reversible directions. A traveler is affixed to the door and drivingly engaged with the drive member for movement in a first direction along the track in response to rotation of the drive member in a first direction and for movement in an opposite direction along the track in response to rotation of the drive member in a reverse direction. The elongate drive member may assume the form of a flexible spirally wound helix.

The previously described coupling means may be practiced in connection with conventional prior art sections. In addition thereto, the coupling means may be practiced in combination with a section fabricated in accordance with the teachings of the instant invention. In a preferred embodiment, the section of the instant invention includes a base member having upper and lower longitudinal edges and a fascia securable to the base member. The base member defines one side of the section while the fascia defines the other side of the section. The element and the complemental element of the coupling pair extend along respective longitudinal edges. More specifically, the base member is generally C-shaped in cross section including an intermediate upright panel having upper and lower terminal portions angularly projecting from the panel in spaced, parallel relationship. The longitudinal edges are carried by respective terminal portions. The panel, the terminal portions and the fascia define an enclosed cavity within the section. Further provided is an insulative material within the cavity.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which: FIG. 1 is an illustration, in fragmentary perspective view, of a vertically moveable sectional door constructed in accordance with the teachings of the instant invention as it would appear when installed for selectively closing an opening in a structural enclosure; FIG. 2 is an enlarged fragmentary horizontal sectional view taken along line 2—2 of FIG. 1; FIG. 3 is an enlarged vertical sectional view taken along the line 3—3 of FIG. 1; FIG. 4 is an enlarged fragmentary elevational view of the embodiment of FIG. 1.

1.

FIG. 8 is an enlarged fragmentary vertical sectional view taken along the line 8—8 of FIG. 1 and further illustrating the coupling of two or more sections of the type seen in FIG. 7;

FIG. 10 is an illustration generally similar to the illustration of FIG. 8 and showing the sections thereof as they would appear in the extended position;

FIG. 11 a view generally similar to the view of FIG. 8 showing an alternate embodiment of the invention as the sections would appear in the retracted position;

FIG. 12 is a view generally corresponding to the view of FIG. 11 and showing the sections thereof as they would appear in the extended position;

FIG. 28 is a perspective view of a hinge, constructed in accordance with the teachings of the instant invention, as it would appear hingedly coupling two members;

FIG. 29 is a partial perspective view of a first portion of the hinge illustrated in FIG. 28;

FIG. 30 is a partial perspective view of a second portion of the hinge illustrated in FIG. 28;

FIG. 31 is a cross sectional end view of the first portion illustrated in FIG. 29;

FIG. 32 is a cross sectional end view of the second portion illustrated in FIG. 30;

FIG. 33 is a cross sectional end view of a fully retracted hinge;

FIG. 34 is a cross sectional side view of a fully extended hinge;

FIG. 35 illustrates a cross sectional end view of the second portion with an attachment means;

FIG. 36 illustrates a cross sectional end view of the second portion with an alternate attachment means;

FIG. 37 is a fragmentary perspective view of a sectional door having alternate guide means;

FIG. 38 is a fragmentary perspective view of another alternate hinge means for coupling two adjacent sections of a sectional door;

FIG. 39 illustrates a cross sectional view of the upper portion of the hinge illustrated in FIG. 38;

FIG. 40 illustrates a cross sectional view of the lower portion of the hinge illustrated in FIG. 38;

FIG. 41 is an end view of the hinge illustrated in FIG. 38;

FIG. 42 is an end view of the hinge illustrated in FIG. 38, in a partially open position;

FIG. 43 is an exploded fragmentary perspective view showing the guide means illustrated in FIG. 37 used in connection with the hinge means of FIG. 38;

FIG. 44 is a fragmentary cross section showing the guide means and hinge of FIG. 43 as assembled;

FIG. 45 is an end view showing the members of the hinge means illustrated in FIG. 38, vertically displaced from one another; and FIG. 46 is an enlarged sectional view of the hinge means illustrated in FIG. 38, with base, fascia, and auxiliary seals added.

DETAILED DESCRIPTION OF THE PREFERRED EMBODIMENTS

Figure 5:
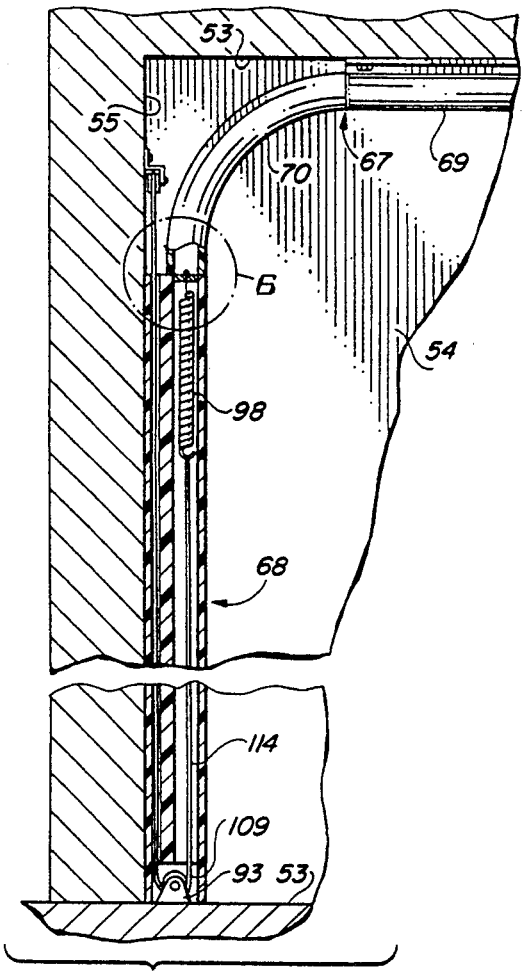
FIG. 5 is a fragmentary vertical sectional view taken along the line 5—5 of FIG.

Turning now to the drawings in which like reference numerals indicate corresponding elements throughout the several views, attention is first directed to FIG. 1 which illustrates a structural enclosure, such as a building, as seen from the interior and generally designated by the reference character 50. Enclosure 50, herein set forth for purposes of orientation and reference in connection with the ensuing detailed description of preferred embodiments of the instant invention, typically includes substantially horizontal floor and ceiling 52 and 53, respectively, and upright walls 54 and 55. Doorway 57 is defined within wall 55. In accordance with the instant invention, a sectional door, generally designated by the reference character 58 and including a plurality of horizontally extending elongate sections 59, spans opening 57 and is supported for vertical movement by guide means, generally designated by reference character 60, affixed to wall 55 and ceiling 53. Sectional door 58 and guide means 60 comprise an embodiment of the sectional door assembly of the instant invention as will now be described in detail.

Referring more specifically to FIG. 2, it is seen that each section 59 includes inner side 62, outer side 63 and lateral edge 64. Bore 65 extends inwardly from edge 64. Section 59 is shown as being typically representative of the specific embodiments of the sections constructed in accordance with the teachings of the instant invention for purposes of orientation and reference in connection with the ensuing detailed description of the guide means 60. Detailed descriptions of the preferred embodiments of the section will be made presently.

Guide means 60, in accordance with the immediately preferred embodiment thereof as seen with particular reference to FIG. 1, includes a track generally designated by reference character 67, including vertical section 68, horizontal section 69 and arcuate transition section 70. Vertical section 68 is affixed to wall 55 adjacent to doorway 57. Horizontal section 69 is secured to ceiling 53. Transition section 70 extends between the upper end of section 68 and the outboard end of section 69. Section 68 and 69 are secured to the respective surfaces by conventional fastening means such as lag bolts as will be presently explained in greater detail. Although not specifically herein illustrated, it will be appreciated by those skilled in the art that a mirror image track 67 is similarly affixed at the other end of opening 57.

Referring again to FIG. 2, it is seen that vertical section 68 which is preferable fabricated by extruding a rigid plastic material such as polyvinyl chloride (PVC), includes a generally tubular guide portion 72 and a pedestal like mounting portion 73. Outer surface 74 of guide portion 72 is generally U shaped in cross-section having semi-circular central portion 75 and terminating with ears 77. It is understood that the ears 77 extend continuously along the length of the section and are directed toward the surface upon which the section is mounted. Track portion 72 may be characterized as tubular, including bore 78 having cylindrical sidewall 79. Mounting portion 73 includes surface 80, which is received against wall 55, and diametrically opposed outwardly extending flanges 82, through which are received lag bolts 83 for attachment to wall 55 in accordance with techniques standard in the art. A second bore 84 also extends longitudinally through section 68. Section 69 is identical in cross section to section 68. Section 70 is also analogous except for the omission of mounting portion 73.

Guide member 87, as seen with additional reference to FIG. 4, projects from the lateral edge 64 of section 59 and is slidably engaged with the guide portion 72 of track 67. For this purpose, guide member 87 is provided with a body 88 having a female or inner surface 89 which matingly and slidably receives the outer surface of guide portion 72. Surface 89 terminates at either end with inwardly directed U shaped portions 90 which matingly and slidably engaged respective ones of the ears 77. Accordingly, body 88 is captively affixed to track 67. Shaft 92, projecting from body 88, is received within bore 65 of section 59.

Preferably, at least one guide member 87 is associated with each section 59. It is also preferred that shaft 92 is rotatably and telescopically received within bore 65. The rotation between bore 65 and shaft 92 accommodates any misalignment which may occur between the track 67 and each individual section 59. The telescoping movement between shaft 92 and bore 65 provides for thermal expansion and contraction of the several sections 59.

Bracket 93 carrying rotatably mounted pulley 94 is carried at the lower end of vertical section 68. A second bracket 95 carrying rotatably mounted pulley 97 is secured to wall 55 preferably the header over doorway 57.

Figure 6:
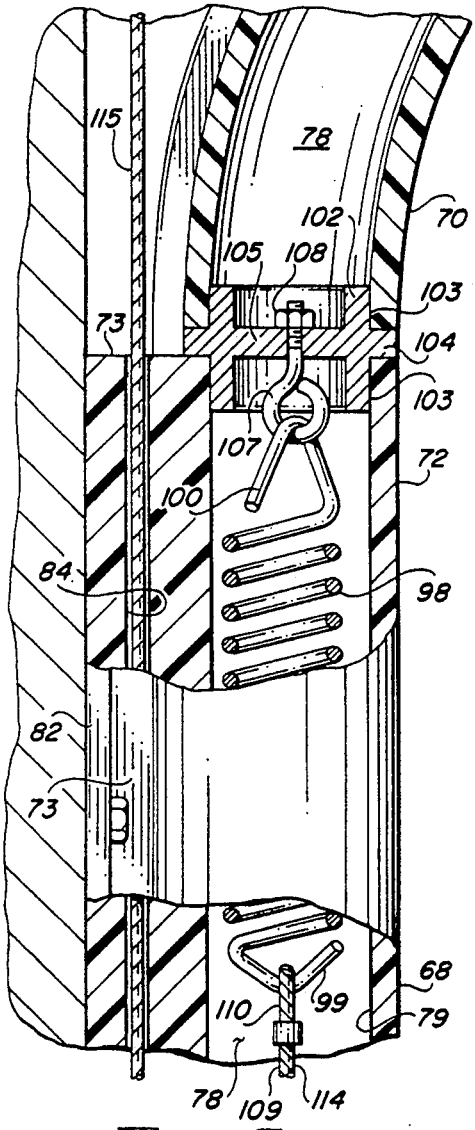
FIG. 6 is an enlarged fragmentary view taken within the inset area designated by the broken outline 6 in FIG. 5.

An extension tension spring 98, terminating at the lower end with hook 99 and at the upper end with hook 100 resides within track 67, more specifically proximate the upper end of section 68 as illustrated in FIGS. 5 and 6. Coupling member 102 having outer cylindrical surface 103 which is sized to be closely received within bore 78 and having outwardly projecting angular flange 104 which rests upon the upper end of section 68, serves to join the section 68 and 70. Further including transverse wall 105, coupling member 102 also functions as a hanger for spring 98. Eye bolt 107, extending through wall 105 and affixed by nut 108, engageably receives and holds upper hook 100 of spring 98. An elongate flexible member 109, such as a conventional stranded steel cable, terminates at one end with loop 110 through which passes lower hook 99 of spring 98. Loop 112, formed at the other end of flexible member 109, is secured to the lowermost section 59 of door 58 as by bolt 113. Intermediate the ends flexible member 109 extends from the lower end of spring 98 around pulley 94, upwardly through second bore 84, and around pulley 97. For descriptive purposes, flexible member 109 is considered as having a first section 114, a second section 115 and a third section 117.

Figure 7:
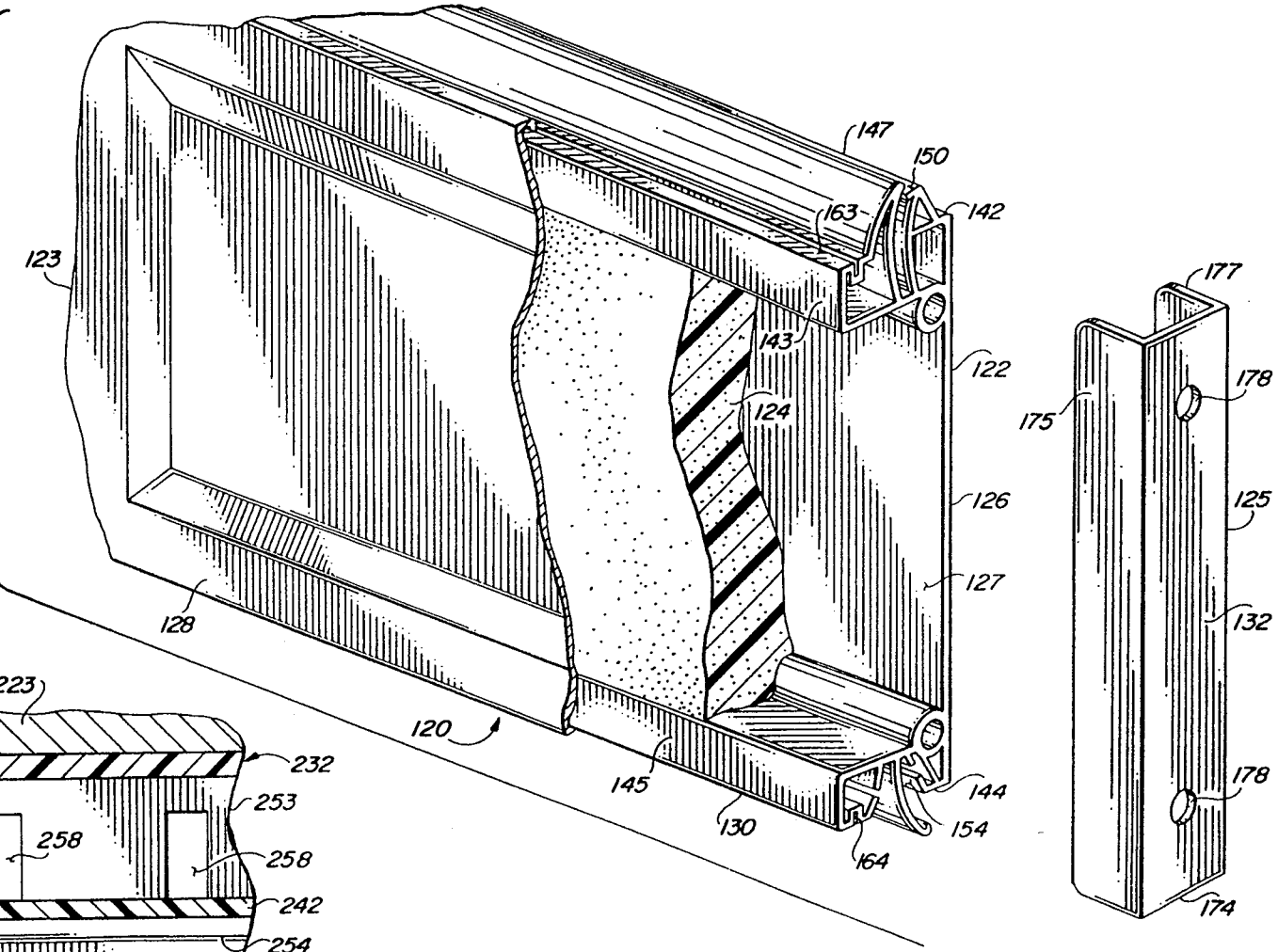
FIG. 7 is a partially exploded fragmentary perspective view of a panel embodying the principles of the instant invention and useful in assembling the door of FIG. 1.

For purposes of reference in connection with the foregoing detailed description of the guide means of the instant invention, sections 59 were set forth as being generally representative of sections constructed in accordance with the teachings of the instant invention or conventional prior art structures. Several alternate sections, each embodying the principles of the instant invention, will now be described in detail. Reference is first made to FIG. 7 wherein there is illustrated a section, which to preclude any confusion, will be generally represented by the reference character 120.

Door section 120, in accordance with the immediately preferred embodiment thereof, is fabricated of several separate members including base 122, fascia 123, insulative filler 124 and end member 125. As will be appreciated by those skilled in the art, section 120 has a length which is sufficient to span the opening 57 as described in connection with FIG. 1. Although not specifically illustrated, an end member 125 is secured to each lateral edge. As an assembly of the several components, section 120 includes interior side 126, exterior side 128, upper longitudinal edge 129, lower longitudinal edge 130 and lateral edge 132, only one of the latter being illustrated.

With additional reference to FIG. 8, it is seen that base 122 is generally C-shaped, having intermediate upright panel 123 with outwardly turned upper and lower terminal portions 124 and 125, respectively. A cavity 127 is formed within the C-shaped base 122 by the inner surface 128 of panel 123, the under surface 129 of upper terminal portion 134 and the top surface 140 of the lower terminal portion 135. The outer surface of base 122 is synonymous with the interior surface 127 of base 122. Each terminal portion 134 and 135 is generally rectangular in cross-section. Upper terminal portion 134 further includes top surface 142 which is substantially parallel to the surface 139 and upright surface 143 which opposes surface 127. Similarly, lower terminal portion 135 includes bottom surface 144 and upright surface 145, which are substantially parallel to the surfaces 140 and 127, respectively.

A projection 147 extends along the upper longitudinal edge 129. Projection 147, which appears as a truncated triangle in cross-section, is formed by surfaces 148 and 149 which extend upwardly convergent from surface 142. Surfaces 148 and 149 terminate at the free end in a spaced relationship to define opening 150 of groove 152 which is continuous along the upper longitudinal edge 129 of section 120. Continuously extending lip 153 extends along the opening 150. It is noted that groove 152, viewed in cross section, is generally arcuate, being curved in the same direction as transition section 70 of track 67. That is, groove 152 is arcuate in cross-section along a line define by a radius projecting from a center residing on the interior side of the door section. It is also noted that projection 153 projects from the interior side of the section to a location intermediate opening 150.

A recess 154 extends along the lower longitudinal edge 130 of section 120. Recess 154 is defined by surfaces 157 and 158 which converge inwardly from surface 144. The recess 154 is sized and shaped to matingly receive the projection 147 of the adjacent section. Tongue 159 depends from within recess 154 to be received within the adjacent groove 152. Tongue 159, which extends continuously along lower lateral edge 130, is arcuate in cross section to be substantially concentric with the arcuate configuration of groove 152. Terminal portion 160 of tongue 159 is generally U-shaped in cross section as will be further explained presently.

A T-shaped slot 162 is formed into the surfaces 157 and 158 for purposes which will be explained presently. Also noted is slot 163 formed in surface 142 and slot 164 formed into surface 144.

A pair of cylindrical bores 166 extend longitudinally of the base 122. One bore 166 resides proximate the apex of the surfaces 138 and 139, while the other bore 166 resides proximate the apex of surfaces 140 and 138. Each bore 166 functions as a socket for receiving the shaft 92 of a guide member 87. It will be appreciated that the bores 166 will also receive the shaft of a roller guide member whereby the section 120 is usable in connection with the conventional prior art guide means including the typical C shaped channel track.

Fascia 123, a relatively thin rigid member, carries exterior surface 128 of section 120 and further includes inner surface 165 which resides against the surfaces 143 and 145 of base 122. At the upper longitudinal edge 167, fascia 123 includes inwardly turned portion 168 which extends over surface 142 and terminates with depending lip 169 residing within slot 163. At the lower longitudinal edge 170, fascia 123 includes inwardly turned portion 172 which resides against surface 144 and upwardly projecting lip 173 which is received within slot 164. Fascia 123, in addition to other functions, serves to close cavity 127.

End member 125, being generally U-shaped in cross-section, includes center section 174 and spaced apart integral flanges 175 and 177. Openings 178 extend through center section 174. The height of end member 125 generally corresponds to the distance between surfaces 142 and 144 of base 122. In the completed assembly, flange 175 is received over the terminal portion of fascia 123 and the flange 177 is received over the terminal portion of base 122. The openings 178 align with respective ones of the bores 163.

Analogous to conventional prior art practice, several of the sections 120 are joined to form a sectional door. The upper longitudinal edge of each panel is coupled with a lower longitudinal edge of the adjacent section. When the door is in the closed position, as especially seen in FIG. 8, each tongue 159 resides substantially within the respective groove 152. Each projection 147 resides within the adjacent recess 154. The mating engagement of the several respective elements functions as a weather seal between sections. Further, the engagement of the projection with the recess provides structural reinforcement when the door is closed.

Figure 9:
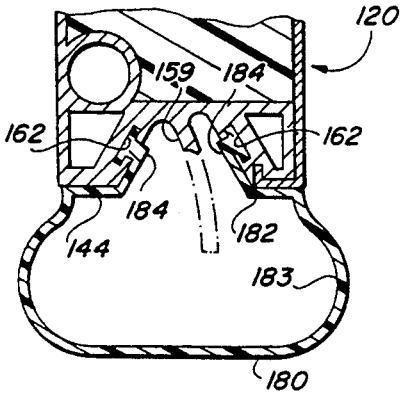
FIG. 9 is an enlarged fragmentary vertical sectional view taken along the line 9—9 of FIG. 1.
Figure 9A:
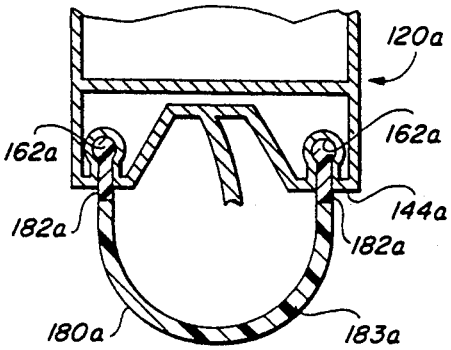
FIG. 9A is an illustration generally similar to the view of FIG. 9 and showing and alternate embodiment thereof.

Seen in FIG. 9 is a bottom weather seal 180 extending along the lower longitudinal edge 130 of the lowermost section 120 for sealing engagement with the floor 52. Preferably, seal 180 includes rigid attachment portion 182 and flexible sealing portion 183. Portion 182 is sized and shaped to be matingly received against the surfaces 144, 157 and 158 and against the portion 172 of fascia 123. T-shaped attachment elements 184 are matingly and engageably received within respective T-slots 162. In preparation for attaching seal 180, at least a portion of tongue 159 is severed and removed to provide for compression of the seal 180. Structures of the foregoing type are readily fabricated by the commercially recognized Dual Durometer process wherein the rigid component and the flexible component, both being of a plastic material, are inherently bonded during the extrusion process.

FIG. 9 illustrates alternate means for sealingly engaging the lower longitudinal edge of the lower most section with the floor. Illustrated, for purposes of reference, is a representative section **120*a* having lower longitudinal edge 144*a*. A pair of spaced apart key-hole slots 162*a* extend longitudinally along edge 144*a*. Seal member 180*a* includes rigid attachment portions 182*a* extending along either edge of the flexible sealing portion 183*a*. Portions 182*a* are sized and shaped to be matingly received within slots 162*a*. The foregoing weather seal 180, described in detail in connection with FIG. 9, requires that the rigid attachment portions 182** be pre-formed or molded to lie in juxtaposition to the lower longitudinal surface and the surfaces of the recess. The immediate embodiment provides that the seal member may be fabricated as a flat sheet-like member which is manually arched at the time of assembly with the section.

The door comprising the several sections 120 may be lifted by the lowermost section such as illustrated in connection with FIG. 1. Alternately, the door may be lifted by the topmost section, such as by a conventional electric door opening device. In response to lifting by the top section, the adjacent respective longitudinal surfaces will be specially displaced. Additionally, angular displacement will occur as seen in FIG. 10, in response to traversing the arcuate transition section 70. Separation between adjacent sections is limited by the engagement of terminal portion 160 of tongue 159 with lip 153 of groove 152.

An alternate section, generally designated by the reference character 190 and embodying the principles of the instant invention, is illustrated in FIGS. 11 and 12. Analogous to the previously described sections 120, several of the sections 190 may be coupled to provide a sectional door. In further similarity, each section 190 includes base 192 fascia 193 and insulative filler 194.

Base 192 carries top surface 195 and bottom surface 197 which also function as the upper and lower longitudinal edges, respectively, of the section 190. Upwardly divergent surfaces 198 and 199 extend from top surface 195 to form an upstanding projection which is generally triangular in cross section. Longitudinally extending groove 200 depends from opening 202 approximate the zenith or apex of the surfaces 198 and 199. Lug 203 projects from surface 198 inwardly of opening 202. Surface 199, at the lower end, projects below surface 195 to form a notch 204 to receive the attachment lip 205 of fascia 193.

Upwardly convergent surfaces 207 and 208 define a recess in bottom surface 197 which is substantially triangular in cross section and sized and shaped to receive the projection upstanding from surface 195. Tongue 209 depends from within the recess and is extendably and retractably received within groove 200. The free edge or lower terminal portion 210 of tongue 209 is enlarged to substantially correspond with the cross section of groove 200 and to abut against lip 203 when tongue 209 is extended from groove 200.

The immediate embodiment of the instant invention is especially adapted to be lifted by the upper most section. FIG. 11 illustrates the coupling between adjacent sections as it would appear when the door is closed with each section resting upon the immediately lower section. In this position, tongue 209 is fully retracted within groove 200. As the upper most section is lifted, each successive section is specially displaced from the adjacent section as seen in FIG. 12. In this configuration, tongue 209 is fully extended with free edge 210 abutting lip 203 for lifting the lower section. With the tongue in the extended position, lip 203 and free edge 210 function as pivotal coupling members for angular displacement between adjacent sections. In all other aspects not specifically illustrated nor described, the sections 190 are analogous to the previously described sections 120.

Figure 13:
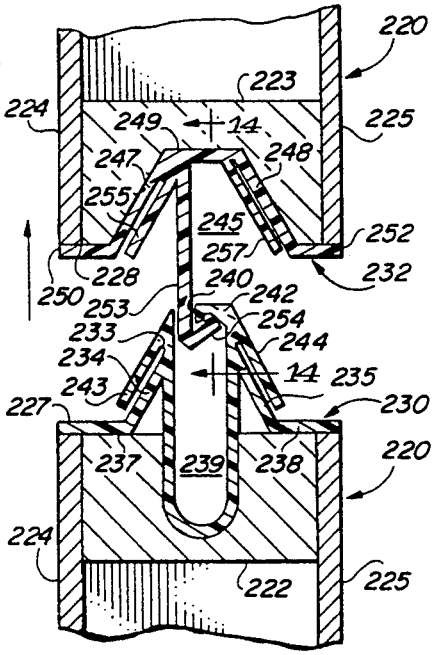
FIG. 13 is a view generally similar to the illustration of FIG. 12 and showing an alternate embodiment thereof.

An alternate coupling means for joining adjacent sections will now be described with reference to FIG. 13. For purposes of illustration, the attachment means are shown as elongate members affixed to conventional hollow core sections, generally designated by the reference character 220 and fabricated in accordance with the known prior. Each section 220 includes an upper longitudinal frame member 222 and a lower frame member 223 which carry outer skin 224 and inner skin 225. The sections further include upper longitudinal edge 227 and lower longitudinal edge 228. As will be appreciated by those skilled in the art, a coupling means of the instant invention may be fabricated as separate components which are affixed to conventional prior art sections or, alternately, integrally fabricated with the sections in accordance with the detailed descriptions of the embodiments generally designated by reference character 120 and 190.

The immediate coupling means includes first and second members generally designated by the reference characters 230 and 232, respectively. First member 230 is specially devised to be secured to the upper longitudinal edge 227 while second member 232 is securable to the lower edge 228. Each member is hermaphroditic, the projection and the groove being carried by the first member while the recess and the tongue are carried by the second member. Although illustrated in cross section, it will be appreciated that each member is elongate to extend along the respective longitudinal edge.

More specifically, projection 233 of first member 230 is defined by upwardly convergent side elements 234 and 235 which extend from diametrically opposed outwardly extending flanges 237 and 238, respectively. The flanges 237 and 238 are affixed to the upper longitudinal edge 227 by any conventional means, such as adhesive bonding or mechanical fasteners. Groove 239 having opening 240 resides intermediate the side elements 234 and 235. Lip 242 projects inwardly of opening 240 from side element 235. Flap 243 depends from approximate the top of projection 233 to lie in space parallel relationship to the side element 234. Similarly, flap 244 depends from approximate the top of projection 233 to reside in space parallel relationship with the side element 235.

Projection 245, in second member 232, is defined by upwardly convergent side elements 247 and 248 which are joined at the upper ends by transverse element 249. At the lower end, side elements 247 and 248 terminate with outwardly extending mounting flanges 250 and 252, respectively. Tongue 253 depends from element 249 and terminates with hook-shaped terminal portion 254 for purposes previously described. Flaps 255 and 257 extend from transverse element 249 to reside in spaced parallel relationship to the side elements 247 and 248, respectively.

Figure 14:
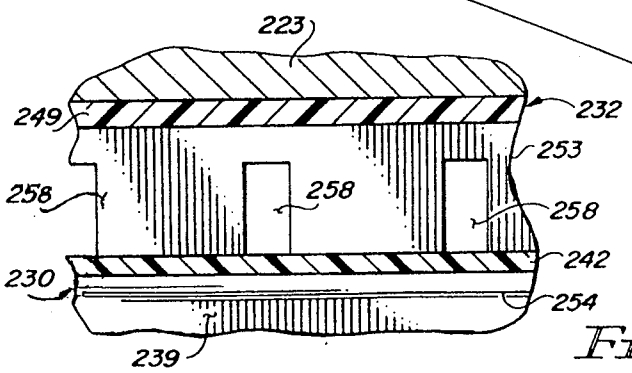
FIG. 14 is a fragmentary vertical sectional view taken along the line 14—14 of FIG. 13

In general, the function of the immediate embodiment is analogous to the function of the previously described embodiments to provide for special and angular displacement between adjacent sections. However, when adjacent sections are brought together, as when the sectional door is closed, the flaps 243 and 244 are frictionally and sealingly engaged with the flaps 255 and 257, respectively. Accordingly, adjacent sections are mutually reinforced for strength and an air-tight seal is formed therebetween. The immediate embodiment also provides for ventilation of the enclosure without the necessity of opening the door. With reference to FIG. 14 it is seen that a plurality of openings or slots 258 extend along tongue 253. When the door is fully closed, the slots 258 reside within the respective groove 239. In response to the uppermost panel being lifted sufficiently for special displacement between adjacent sections, moving each tongue 253 into the extended position, the several slots 258 are exposed for passage of air through the door. It will be appreciated that the slots 258 may also be incorporated into the previously described tongues 159 and 209.

Figure 15:
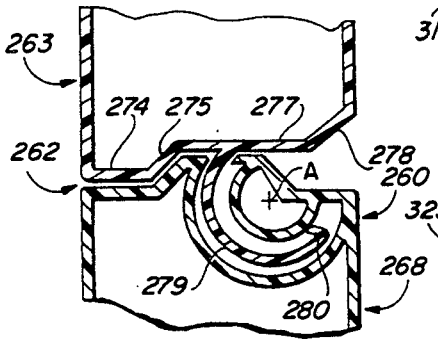
FIG. 15 is yet another view generally corresponding to the view of FIG. 8 and showing the panels thereof in the retracted position.
Figure 16:
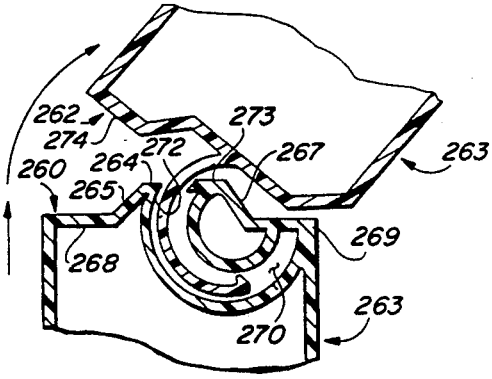
FIG. 16 is a view generally corresponding to the illustration of FIG. 13 and showing the panels thereof as they would appear in the extended position.

Turning now to FIGS. 15 and 16 there is seen an alternate coupling means including first and second members 260 and 262, respectively, which provide for angular displacement between adjacent sections generally designated by the reference character 263 for reference. Consistent with the previously described embodiments, the members 260 and 262 may be fabricated integrally with the section or as separate components to be attached to conventional prior art sections. Further, first member 260 extends along the upper longitudinal edge of the panel 263 while second member 262 extends along the lower longitudinal edge of the panel 263.

Analogous to previously described embodiments, first member 260 includes projection 264 defined by upwardly convergent side elements 265 and 267 which extend from the flange portions 268 and 269, respectively. Groove 270 having opening 272 extending along the top of projection 262 resides intermediate side elements 265 and 267. Lip 273 projects inwardly of opening 272 from side element 267.

Second member 262 includes flange portion 274 which opposes flange portion 268 and a recess defined by upwardly inwardly extending side element 275 and transverse surface 277. Along the inside surface of the section, beveled edge 278 terminates transverse element 277. Tongue 279 having enlarged terminal portion 280, for purposes previously described, depends from transverse element 277.

In cross section, groove 270 and tongue 279 are semicircular and reside in concentric relationship with the longitudinal axis seen from the end and represented by the crossed lines designated A. Accordingly, the sections 263 are hingedly coupled for rotation about the axis A between a closed position as seen in FIG. 15 and an open position as seen in FIG. 16. Beveled edge 278 prevents interference between transverse element 277 of second member 262 and flange portion 269 of the first member 260.

Figure 17:
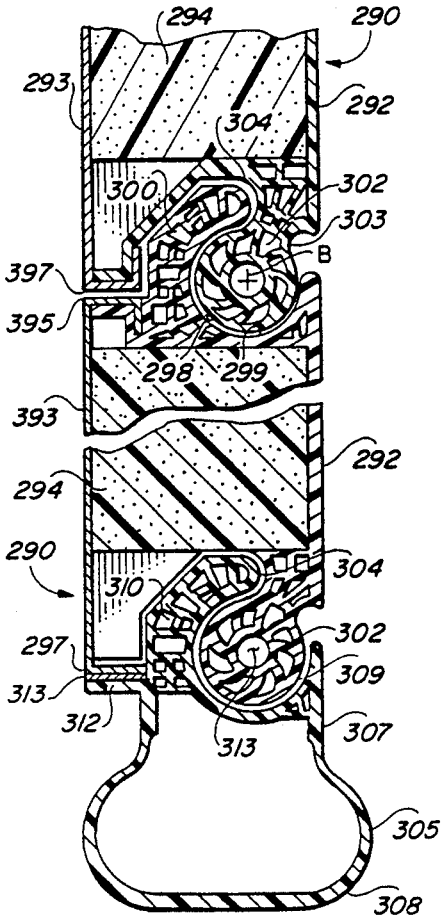
FIG. 17 is a view generally corresponding to the view of FIG. 8.

Turning now to FIG. 17 there is seen an alternate section constructed in accordance with the teachings of the instant invention and generally designated by the reference character 290. The section 290, analogous to the previously described embodiments of the invention, includes base portion 292, fascia 293 and insulative filler 294. Upper longitudinal edge 295 and lower longitudinal edge 297 extend along each section 290. Carried by the edges are coupling means for hingedly securing adjacent sections. As in the previously described embodiments, the coupling means includes first and second members, each of which is hermaphroditic.

Extending along top surface 295 is cylindrical socket 298 defined by surface 299 which is concentric about the longitudinal axis seen from the end and represented by the crossed lines designated B. At the outboard edge, surface 299 opens to the interior side of the panel 290. At the inboard edge, side surface 299 continues to form one side of substantially arcuate projection 300. Pintle member 302, defined by outer surface 303 which is also concentric about the longitudinal axis B, is rotatably received within socket 298. Arcuate recess 304 receives projection 300 when adjacent sections 290 are aligned, as in the closed position of the sectional door. Projection 300 and pintle member 302, being relatively thin-walled members, are reinforced by integral webbing as will be readily understood by those skilled in the art of extruding plastic materials.

Seal 305, analogous to previously described seal 180, including attachment portion 307 and seal portion 308, is secured to the lower longitudinal edge 297 of the lowermost section 290 for sealing engagement with the floor. Preferably, seal portion 308 is a hollow bellows-like structure. Alternately, seal section 308 may assume other forms such as a flexible lip or flap. Attachment portion 307, which is reinforced by integral webbing, includes female portion 309 which matingly and engageably receives pintle member 302 and male portion 310 which is matingly and engageably received within recess 304. For further securement, attachment portion 307 may include outwardly extending flange 312 which is affixed to lower longitudinal edge 297 as by double-sided tape 313 as illustrated or any conventional fastening means. The lower edge of each section 290 is securable to the track means by reason of bore 313 concentrically carried within pintle member 302 for receiving the shaft of the guide member or roller carriage.

Figure 18:
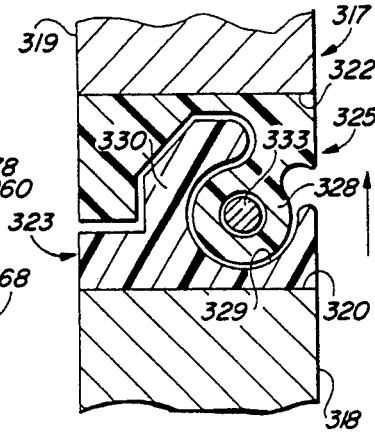
FIG. 18 is a view generally corresponding to the central section of FIG. 16 and showing an alternate coupling means.
Figure 19:
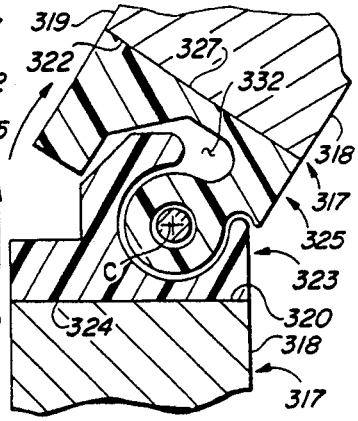
FIG. 19 is a view generally corresponding to the view of FIG. 17 and showing the coupling means as it would appear when the sections are angularly displaced.

Coupling means of the type described in connection with FIG. 17 may also be fabricated for use in connection with conventional prior art door sections. With reference to FIGS. 18 and 19, there is seen a section generally designated by the reference character 317 and having interior surface 318, exterior surface 319, upper longitudinal edge 320 and lower longitudinal edge 322.

The immediate coupling means includes a first member, generally designated by the reference character 323, having a mounting surface 324 which is affixed to the upper longitudinal edge 320 by any conventional means such as an adhesive or mechanical fasteners. A second member generally designated by the reference character 325 has a mounting surface 327 which is similarly affixed to the lower longitudinal edge 322. Pintle member 328 of second member 325 is rotatably received within cylindrical socket 329 formed in the first member 323. Projection 330 upstanding from first member 323 is received within recess 332 formed into second member 325. Shaft-receiving bore 333 resides within pintle member 328. The members 323 and 325 are relatively rotatable about the longitudinal axis seen from the end and represented by the crossed lines designated C.

A preferred method of constructing a section, such as those previously described herein in detail, will now be set forth with specific reference to FIG. 7. Preferably, base 122 is made of a rigid plastic material, such as polyvinyl chloride, by the continuous injection-molding process. The extended length produced is then laterally cut into completed units having a length predetermined by the selected opening or doorway. Conventional coloring agents are utilized during the molding process to provide any desired color. Optionally, ventilation openings may be formed in the tongue.

Fascia 123 is preferably fabricated of relatively thin sheet metal in accordance with techniques known in the art including embossing or stamping to impart a desired design. The length of the fascia is approximately the same as the length of the base 122. The exterior surface of the fascia may be decorated or colored as by painting or anodizing as appropriate to the selected material. The completed fascia is assembled with the base by telescoping engagement with the lips thereof being received within the respective slots of the base.

Subsequent to the assembly of base 122 and fascia 123, the cavity 127 is filled with insulative material. The preferred material is urethane foam which is injected in accordance with a conventional known prior art process. Finally, after any flash of the foam at the ends of the section is trimmed as may be required, the end member 125 is affixed and secured by any conventional technique.

Alternate methods of producing a section are also contemplated by the instant invention. For example, the insulative material 124 may be cut to size from previously produced slabs and placed in the cavity 127 prior to assembly of the fascia 123 with the backing 122. Further, the base and the fascia may be concurrently fabricated and assembled from a plastic material by the known co-extruding process. Coloring agents incorporated into the raw materials will produce finished sections of desired colors.

Figures 20, 21, 22, 23:
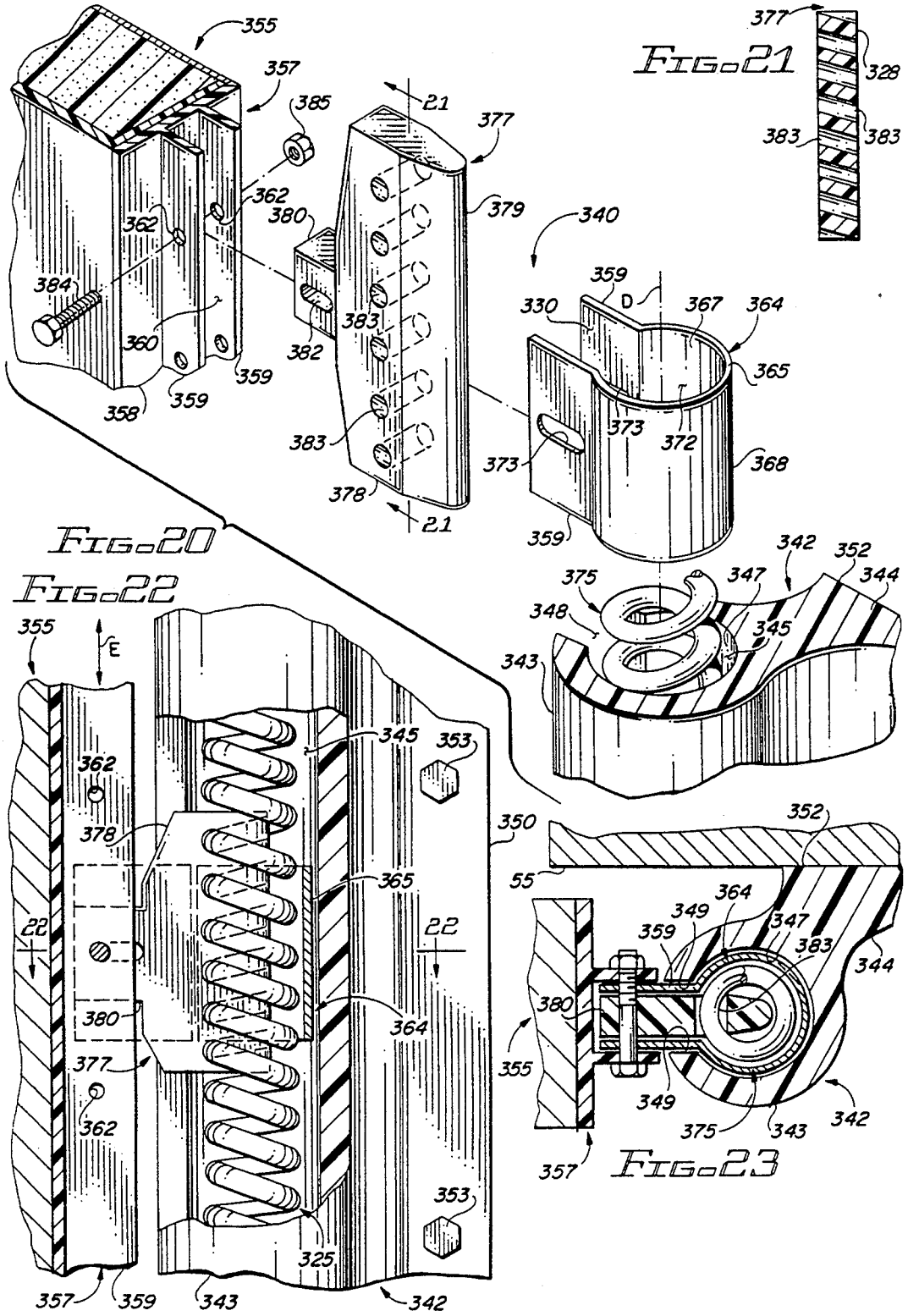
FIG. 20 is an exploded fragmentary perspective view of alternate guide means securable to a structure for carrying a sectional door in accordance with the teachings of the instant invention.
FIG. 21 is a vertical sectional view taken along the line 20—20 of FIG. 19.
FIG. 22 is a fragmentary elevational view partly in section showing the elements of FIG. 19 as they would appear when assembled.
FIG. 23 is a horizontal sectional view taken along the line 22—22 of FIG. 21.

Turning now to FIG. 20 there is seen an alternate drive means generally designated by the reference character 340 which is power actuated, as by an electric motor, for raising and lowering a sectional door having sections fabricated in accordance to the teachings of the instant invention or with conventional prior art sections. First noted is the track, generally designated by the reference character 342. Having a guide portion 343 and a mounting portion 344. Bore 345 having cylindrical sidewall 347 extends continuously along guide portion 343. Slot 348, residing intermediate edge walls 349 as more clearly illustrated in FIG. 23, extends longitudinally through guide portion 343 to communicate with bore 345 in opposition to the lateral edge of the door. Mounting portion 344, as seen with additional reference to FIG. 22, includes outwardly directed flange 350 and mounting surface 352 which is receivable against a selected supporting structure, such as previously described wall 55. A plurality of spaced apart lag bolts 353 pass through flange portion 350 for attachment of the track 342 to wall 55 in accordance with conventional procedure.

For purposes of illustration and reference, there is seen a section generally designated by the reference character 355 which is intended to be typical of sections of the instant invention or of the prior art. An end member of the instant invention generally designated by the reference character 357 is carried along the lateral edge of section 355. End member 357 includes mounting plate 358 which is affixed to section 355 by any conventional means, such as mechanical fasteners or adhesive. A pair of spaced apart parallel flanges 359 extend from mounting plate 358 to define channel 360 therebetween. A plurality of aligned apertures 362 are spaced along the flanges 359.

A guide member, generally designated by the reference character 364, interfaces between track 342 and section 355. Preferably fabricated of relatively thin walled metal, guide member 364 includes generally cylindrical body 365 having inner and outer cylindrical surfaces 367 and 368. Viewed in plan, guide member 364 is generally key-hole shaped having a pair of spaced apart parallel outwardly directed flanges 359 which define slot 370 which communicates with bore 372 defined by inner sidewall 367. A pair of aligned apertures 373 extend through each flange 359 and are elongate along an axis which is generally perpendicular to the longitudinal axis of the guide member 364 as represented by the broken line designated by the reference character D. Body 365 of guide members 364 is slidably carried within bore 345 of guide portion 343 for reciprocal motion in directions indicated by the double arrowed line E in FIG. 22. Outer cylindrical surface 368 of guide member 364 opposes cylindrical sidewall 347 of track 342. Flanges 359 project through slot 348 in close proximity to respective edge walls 349. Although not specifically illustrated, it will be appreciated by those skilled in the art that track 342 comprises three sections, a vertical section, a horizontal section and an arcuate transition section analogous to the previously described track 67. A flexible drive screw, such as sold under the mark Spiroul Drive TM and generally designated by the reference character 375, resides within bore 345 of track 342 and passes through the bore 372 of guide member 364.

Further included in the immediate embodiment is a traveler, generally designated by the reference character 377, having elongate body 378 with rounded nose 379. Lug 380 having aperture 382 passing transversely therethrough, extends from body 378 in a direction diametrically opposed to nose 379. A plurality of openings 383 extend laterally through body 378. The apertures are sized and spaced to threadably receive the flexible drive screw 375 therethrough. Preferably, the apertures are spaced to accommodate the pitch of flexible drive screw 375 and skewed to accommodate the lead thereof.

As particularly seen in FIGS. 22 and 23, bolt 384 concurrently passes through openings 362 in end member 357, opening 382 in traveler 377 and slots 373 in guide member 364. The bolt is secured by nut 385. Accordingly, section 355 is drivingly engaged with drive screw 375. In response to rotation and counter rotation of drive screw 375, traveler 377 and consequently section 355, travel in reciprocal directions as indicated by the double arrowed line E.

Figure 24:
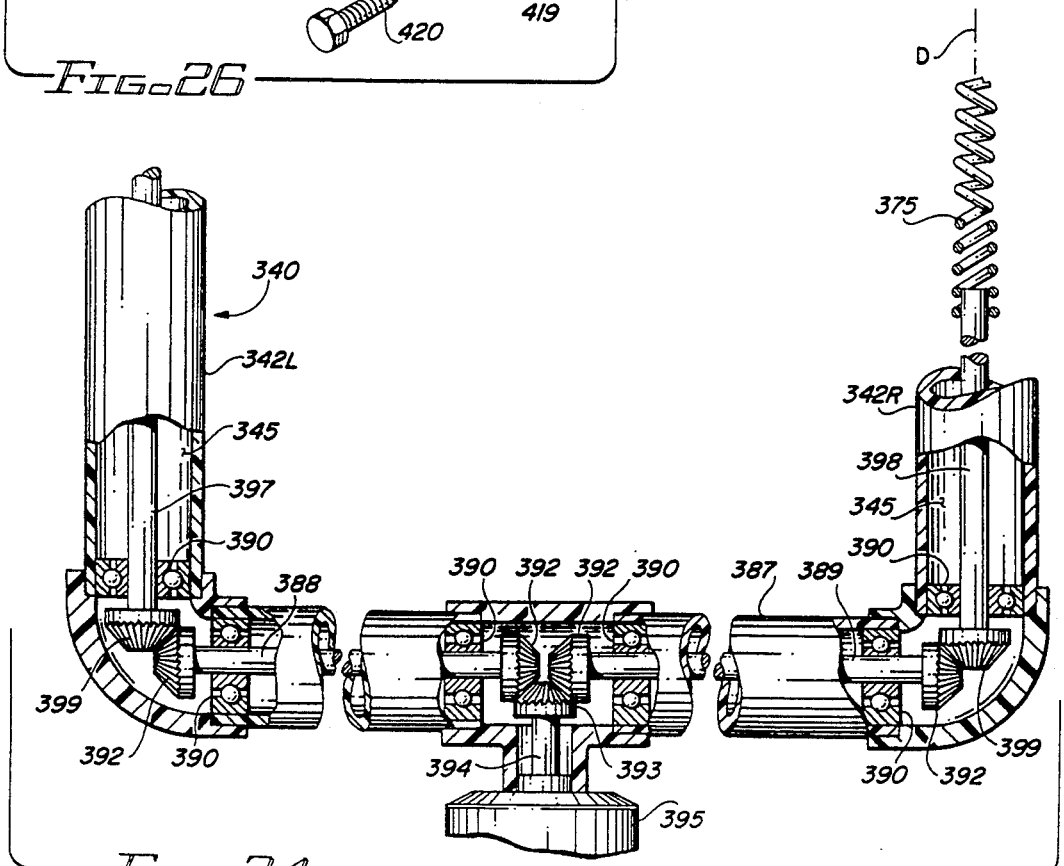
FIG. 24 is a top plan view of drive means useful in connection with the guide means 25 seen in FIGS. 19 through 22, portions thereof being broken away for purposes of illustration.

Those having a concern for the instant subject matter, will readily appreciate that a drive means such as illustrated and described in connection with FIGS. 20 through 23 is preferably utilized on each lateral edge of a sectional door. A preferred drive means for rotating the drive screw 375 of each guide means will now be described with reference to FIG. 24. As previously noted, the track 342 includes an upper horizontal section. For purposes of reference, the horizontal section of the tracks 342 are designated 342L and 342R. For purposes of enclosing the drive means, it is preferred that the ends of the tracks 342L and 342R are joined by transverse tubular member 387.

First and second drive shafts 388 and 389, preferably identical structures, are journaled for rotation within tubular member 387 as by conventional bearings 390. A bevel gear 392 is carried at each end of each shaft 388 and 389. Drive gear 393 drivingly engaged with shaft 394 of reversible electric motor 395 is drivingly engaged with each of the inner most beveled gears 392. It is noted that the shafts 388 and 389 are oppositely rotating and reversible in response to the rotation of motor 395. Motor 395, in accordance with conventional procedure, may be activated by various user means such as wall mounted switches and remote control devices.

Driven shafts 397 and 398 are journaled for rotation within the track sections 342L and 342R, respectively, as by additional bearing 390. At one end, each shaft 397 and 398 carries a bevel gear 399 which is drivingly engaged with the beveled gear 392 of the respective drive shafts 388 and 389. At the other end, each shaft 397 and 398 is affixed to the respective flexible drive screw 375. Accordingly, drive force imparted to the driven shaft is transmitted to the respective drive screw for concurrent rotation about the axis D.

Figure 25:
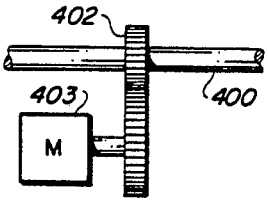
FIG. 25 is a view generally corresponding to the central section of FIG. 25 and illustrating an alternate embodiment thereof.

FIG. 25 illustrates an alternate means of driving the driven shafts 397 and 398. Seen is a single drive shaft 400 which replaces the previously described drive shafts 388 and 389. It will be understood that a beveled gear 392 is carried at either end thereof. At an intermediate location of drive shaft 400, spur gear 402 is drivingly engaged. Gear 402, shaft 400 and subsequently the flexible drive screws 375 are reversibly rotated in response to gear motor 403.

Although specifically described as including drive screw 375 and traveler 377, it will be appreciated by those skilled in the art that modifications thereof are adapted for opening and closing by other means. For example, the elimination of the drive screw and of the follower will provide guide means for a door which is manually openable, or usable with other opening devices as described in connection with the previously set forth embodiment generally designated by the reference character 60.

Figure 26:
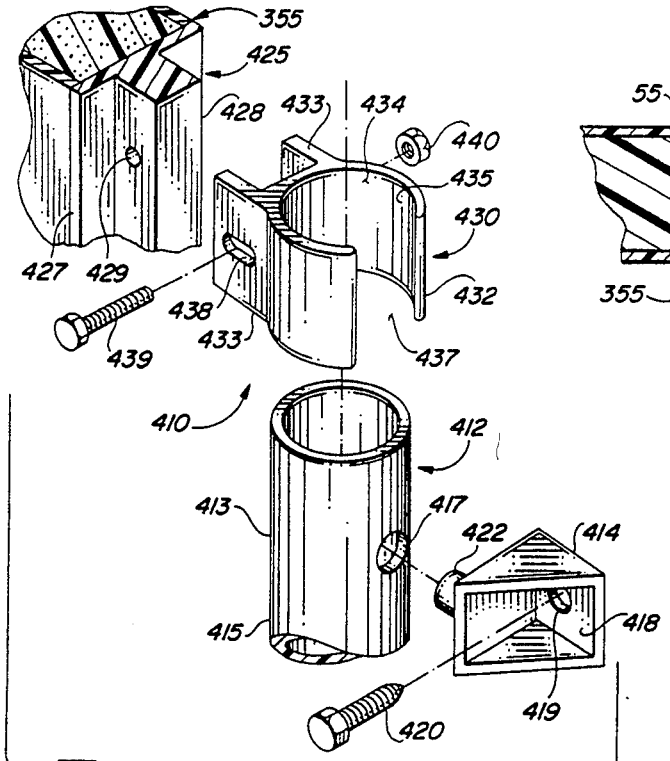
FIG. 26 is a view generally corresponding to the view of FIG. 19 and illustrating alternate guide means constructed in accordance with the teachings of the instant invention.
Figure 27:
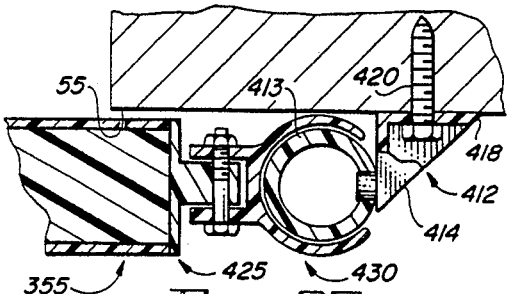
FIG. 27 is a vertical sectional view of the assembled elements of FIG. 23.

With reference to FIG. 26 there is seen yet another guide means, generally designated by the reference character 410 and representing an alternate embodiment of the instant invention. In general similarity to the previously described embodiments, the instant embodiment includes track 412 including a guide portion 413 and a mounting portion 414. Preferably a hollow tubular member, guide portion 413 includes outer cylindrical guiding surface 415. A plurality of apertures 417 are spaced along guide portion 413. Mounting portion 414 is in the form of a plurality of mounting brackets, one associated with each opening 417. The mounting portion 414 includes mounting flange 418 having aperture 419 there through for receiving lag bolt 420 for attachment to the selected structure. Projection 422 extending from the member 414 is received in opening 417 and secured thereto by any conventional means consistent with the material of construction of the track. For example, if the track components are fabricated of metal welding would be considered suitable. Adhesive bonding would be appropriate where the components are fabricated of plastic.

End member, generally designated by the reference character 425 includes mounting plate 427 which is affixed to the lateral edge of section 355 by any desired means. Mounting lug 428 carrying a plurality of spaced apart apertures 429, extends along plate 427.

A guide member, generally designated by the reference character 430, includes body portion 432 from which projects a pair of flanges 433 which are spaced apart to receive the lug 428 there between. Bore 434, having cylindrical sidewall 435 and passing through body portion 432, is sized to be slidably received upon guide portion 413. Body portion 432 is generally C shaped having opening 437 to accommodate the several mounting members 414. Aperture 438 being elongated in a direction generally perpendicular to the longitudinal axis of bore 434, extends through each flange 438. Bolt 439, passing through apertures 429 and 433 for assembly of the guide member to the section, is secured by nut 440. The elongate aperture 438 allows for adjustment during installation of the door assembly and subsequently accommodates thermal expansion of the section.

FIG. 28 illustrates a hinge, generally designated 500. A first portion 510 of hinge 500 is attached to a first member 502. A second portion 530 of hinge 500 is attached to a second member 503. First member 502 and second member 503 may be sections of a sectional door, such as a garage door and used in conjunction with the material previously disclosed, acting as a coupling means between sections, or other sections desired to be hingedly coupled. First portion 510 of hinge 500 extends longitudinally along the entire length of side 504 of first member 502. Second portion 530 of hinge 500 extends longitudinally along side 505 of second member 503. First portion 510 and second portion 530 are coupled, thus hingedly coupling first member 502 and second member 503. Those skilled in the art will understand that more than two members may be coupled together. When more than two members are to be hingedly coupled, first portion 510 of hinge 500 is coupled to side 504 of each member and second portion 530 is coupled to the opposite side 505. Thus, when members are placed together, first portion 510 will correspond to and couple with second portion 530.

FIGS. 29 and 31 illustrate first portion 510 of hinge 500. FIG. 31 is a cross section of first portion 510, illustrating its structure. First portion 510 has a generally rectangular casement 511. Casement 511 consists of a back wall 512 and a front wall 513 joined by sidewalls 514 extending perpendicularly therebetween. Front wall 513 is stepped back from sidewalls 514 towards back wall 512, forming an inset face 515 and steps 516 to either side. Steps 516 and inset face 515 of casement 511 define a space 517 from which a generally arcuate tongue 518 extends. Tongue 518 extends from inset face 515 substantially further than steps 516 and ends in an inwardly curved edge 519. A pair of ridges 521 extend perpendicularly from inset face 515, one on either side of tongue 518. Ridges 521 extend outward to substantially the same distance as steps 516. A support bar 522 in formed between inset face 515 and back wall 512 to provide structural support to casement 511. Referring now to FIG. 29, it can be seen that the elements described in FIG. 31 extend longitudinally the entire length of first portion 510.

FIGS. 30 and 32 illustrate second portion 530 of hinge 500. FIG. 32 is a cross sectional view of second portion 530, illustrating its structure. Second portion 530 has a generally rectangular casement 531 similar to casement 511 of first portion 510. Casement 531 consists of a back wall 532 and a front wall 533 joined by sidewalls 534 extending perpendicularly therebetween. As in first portion 510, front wall 533 is initially stepped back towards back wall 532 forming steps 536 adjacent to each sidewall 534. However, front wall 533 then extends outward forming a projection 535 from surfaces 537 and 538 which are outwardly convergent from the base of each step 536. Surfaces 537 and 538 initially extend outwardly substantially parallel to sidewalls 534 and correspond to ridges 521 of first portion 510. At substantially the same distance outward as steps 536, surfaces 537 and 538 begin converging. Surfaces 537 and 538 terminate in a spaced apart relationship to define an opening 539 of a groove 540. Groove 540 is defined by surfaces 541 and 542 which are inwardly curving extensions of surfaces 537 and 538 respectively. Surfaces 541 and 542 join to form a support bar 543 adjacent to back wall 532, providing structural support to casement 531. Groove 540 is generally arcuate, having a curvature corresponding to the curvature of tongue 518 of first portion 510. A lip 544 extends from the junction of surface 537 and 541. Referring now to FIG. 30, it can be seen that the elements described in FIG. 32 extend longitudinally the entire length of second portion 530.

FIG. 33 illustrates first portion 510 and second portion 530 coupled, and in a fully retracted position. In this position, projection 535 of second portion 530 fits into space 517 of first portion 510, between ridges 521, with tongue 518 fully inserted into groove 540. steps 516 of first portion 510 and steps 536 of second portion 530 fit flush together to support the weight of first member 502 and second member 503. A first seal 545 is formed by tongue 518 and groove 540, preventing passage of matter or light through hinge 500. A secondary seal 546 is formed by ridges 521 where they abut against surfaces 537 and 538 of projection 535. The interlocking structures of first portion 510 and second portion 530 provide a stable and solid joint.

FIG. 34 illustrates hinge 500 in a fully extended position. Tongue 518 is pulled out of groove 540 in a pivotal movement. The axis of the pivotal movement is the outer edge of one of steps 516 and 536 while the other is separated. The pivotal movement of hinge 500 is halted by edge 519 contacting lip 544.

Those skilled in the art will understand that a greater or lesser pivot distance may be obtained by altering the dimensions of first portion 500 and second portion 530.

FIGS. 33, 34, 35 and 36 illustrate attachment means 550 for attaching first portion 510 to first member 502 and second portion 530 to second member 503. FIGS. 33 and 34 show first and second portions 510 and 530 respectively attached to first and second member 502 and 503 by an adhesive. The adhesive used will vary depending on the material used for hinge 500 and members 502 and 503.

A stronger attachment means 550 is illustrated in FIG. 35. In this drawing second portion 530 is shown attached to second member 503. A ridge 551 extends perpendicularly from back wall 532. Compressible flaps 552 extend from ridge 551 at an angle back towards back wall 532. In cross section, ridge 551, with flaps 552, appears as an arrow. A groove 553 is formed in the edge of second member 503. Groove 553 is slightly thinner than the distance between flaps 552, compressing them as ridge 551 is inserted into groove 553. Ridge 551 is inserted, until back wall 532 is pressed flush against the edge of second member 503. The pressure produced between compressed flaps 552 and the walls of groove 553 keep second portion 530 securely in place. Preferably, an adhesive well also be used to strengthen the bond.

A further attachment means is illustrated in FIG. 36. In this embodiment, sidewalls 534 of second portion 530 are extended back past back wall 532 to form flanges 554. The edge 505 of second member 503 fits between flanges 554 and abuts against back wall 532. Screws 555 are inserted through flanges 554 and into second member 503 to secure second portion 530 to second member 503.

FIG. 37 shows a sectional door 558 according to yet another embodiment of the invention, having alternate coupling or hinge means 560, illustrated in FIGS. 38–41, and alternate guide means 562, illustrated in FIGS. 43–44.

As in the previous embodiments, coupling or hinge means 560 includes a first member 564, configured for attachment to the upper longitudinal edge 566 of a door section 568, and a second member 570, configured for attachment to a lower longitudinal edge 572.

FIG. 40 is a sectional view of first member 564, illustrating its structure. As in the embodiment of FIGS. 28–36, first member 564 includes a generally rectangular casement 574 consisting of a back or bottom wall 576 and front or top wall 578 joined by sidewalls 580, 581 extending perpendicularly therebetween. For purposes of clarity, sidewall 580 will be identified as the outer sidewall, since it faces the outer surface of sectional door 558, and sidewall 581 will be identified as the inner sidewall, since it faces the inner surface of the door 558. A slot 582 is formed in inner sidewall 581 proximate bottom wall 576.

A portion of top wall 578 is stepped in proximate outer sidewall 580, forming a generally rectangular recess 583 including inset face 584 bounded by vertical walls 586, 588. One of the vertical walls 588 includes a set of inwardly projecting teeth 590, the purpose of which will be discussed shortly. At a location intermediate recess 583 and inner sidewall 581, a generally arcuate tongue 592 extends upwardly and ends in an inwardly curved edge 594. The inner surface 596 of tongue 592 forms the outer wall of an arcuate groove 598 extending toward bottom wall 576, well beneath top wall. 578. The corresponding inner wall 600 of the groove 598 is generally parallel to tongue 592 and forms a portion of the perimeter of a socket 602. As seen in cross section, the perimeter of the socket is in the form of an arc of more than 180 degrees.

The structure of second member 570 is illustrated in the sectional view of FIG. 39. Like first member 564, second member 570 includes a generally rectangular casement 604. Casement 604 consists of a top wall 606, bottom wall 608, outer sidewall 610, and inner sidewall 612. A generally L-shaped slot 614 is formed in inner sidewall 612.

Bottom wall 608 is stepped in proximate outer sidewall 610 to form a generally rectangular recess 616 which is a mirror image of recess 583 in first member 564 and which includes an inset face 618, vertical sidewalls 620, 622, and teeth 624. Intermediate recess 616 and inner sidewall 612 is formed a groove 626 having a curvature generally corresponding to the curvature of tongue 592 of first member 564. The inner wall 628 of groove 626 forms the outer surface of an arcuate tongue 630 having a curvature corresponding to the curvature of groove 598 in first member 564 and having an inwardly curved edge 632. The inner surface 634 of the tongue 630 forms the outer wall of a second arcuate groove 636 having a curvature corresponding to the curvature of wall 600 of socket 602 of first member 564. The inner wall 638 of the second groove 636 forms a portion of the perimeter of a hollow pintle 640 which depends from bottom wall 608 proximate inner wall 612.

FIG. 41 illustrates first member 564 and second member 570 coupled, and in a closed position. In this position, pintle 640 of second member 570 is received in socket 602 of first member 574, and tongue 630 of second member 570 is fully inserted in groove 598 of first member 574. At the same time, tongue 592 of first member 574 is fully inserted in groove 626 of second member 570, and wall portion 600 of socket 602 is fully inserted in second groove 636. The interlocking structures form a number of seals preventing passage of matter or light through hinge 560, including a first seal 642 formed by the tight fit between pintle 640 and socket 602, a second seal 644 formed by tongue 630 and groove 598, and a third seal 646 formed by tongue 592 and groove 626.

FIG. 42 illustrates hinge 560 after second member 570 has been rotated about the longitudinal axis of pintle 640 to a partially open position in response to an upward pull on sectional door 558. The rotation of second member 570 causes tongue 630 to travel in an arcuate path out of groove 598, and groove 626 to travel in a similar arcuate path away from tongue 592. When hinge 560 reaches its fully open position (not shown), inwardly turned end 594 of tongue 592 engages inwardly turned end 632 of tongue 630, preventing any further rotation of the hinge.

Because the perimeter of socket 602 of first member 564 is formed as an arc of greater than 180 degrees, the upper edges 648, 650 of the socket act as lips for securely retaining pintle 640 in socket 602. Accordingly, hinge 560 normally only allows angular displacement between first member 564 and second member 570. In certain situations, however, it is possible that excessive upward forces may be accidentally exerted on the upper one of adjacent door sections 568*a* and 568*b*, causing wall 600 of socket 602 to flex outwardly and pulling pintle 640 out of socket 602, as shown in FIG. 46. In such situations, the hooked engagement between the inwardly turned ends 594, 632 of tongues 592 and 630, respectively, acts as a safety catch for preventing complete decoupling of the sections 568*a* and 568*b*, and also as a seal for preventing ingress of light, air, and foreign matter.

In addition to first seal 642, second seal 644, and third seal 666, auxiliary means may be provided for enhancing the seal between first member 564 .and second member 570 when hinge 560 is in the closed position, as shown in the cross-sectional view of FIG. 45. The auxiliary means include a first sealing strip 652 carried in recess 583 in first member 564, and a second sealing strip 654 carried in recess 616 in second member 570. Sealing strips 652 and 654 are slightly compressed and tightly retained within their respective recesses 583 and 564 by inwardly projecting teeth 590 and 624. The upper edge of first sealing strip 652 abuts the lower edge of second sealing strip 654, ensuring that no light, air, or foreign matter will enter while hinge 560 is in the closed position. This auxiliary seal is highly desirable since it compensates for flaws in first, second, and third seals 642, 644, and 646, which may arise due to irregularities in the surfaces of the interlocking elements of the hinge 560, resulting from warpage, thermal expansion or shrinking of parts, or imperfections arising during the molding process.

Still further sealing is provided by a dust guard 656 secured to the inner side of hinge 560. Dust guard 656 includes a flexible sealing flap 658 which extends over the inner sidewalls 581, 612 of first and second members 564, 570, respectively, and a rigid mounting portion 660 which projects into L-shaped slot 614 in inner sidewall 612 of second member 564. Mounting portion 660 is in the form of a ridge extending perpendicularly to flap 658 proximate the upper edge thereof. Downwardly projecting teeth 662 formed on the underside of the ridge ensure that the ridge 660 is securely retained within slot 614. Flexible flap 658 and rigid mounting portion 660 are preferably fabricated using the aforementioned Dual Durometer process.

FIG. 45 also illustrates a preferred arrangement for a securing base member 664 and fascia 666 to section 560. Specifically, base 664 includes a first inwardly turned portion 668 at its upper longitudinal edge, and a second inwardly turned portion 670 at its lower longitudinal edge. First inwardly turned portion 668 is received in slot 582 in first member 564 of hinge 560. Second inwardly turned portion 670 is inserted in L-shaped slot 614 of second member 570, and clamped against top wall 606 of second member 570 by mounting portion 660 of dust guard 656.

The upper longitudinal edge of fascia 666 includes inwardly turned portion 672 which terminates with depending lip 674 residing between seal 652 and vertical wall 586 in slot 583 of first hinge member 564. Similarly, the lower longitudinal edge of fascia 666 includes inwardly turned portion 676 which terminates with upwardly projecting lip 678 residing between seal 654 and vertical wall 620 in slot 616 of second hinge member 570.

Attention is now directed to FIGS. 43 and 44, which illustrate alternate guide means 562. In general similarity to the previous embodiments, the instant embodiment includes a guide member 679 slidably received upon a guide portion 680 which is secured to a wall or other surface by a mounting portion (not shown). Guide portion 680 is in the form of a hollow tubular member having an outer cylindrical guiding surface 682.

Guide member 679 includes a generally C-shaped body portion 684 sized to be slidably snapped over guide portion 80. A flange 686 projects outwardly from opposite the open side of body portion 684. A bore 688 extends radially through flange 686 and opens into a longitudinally extending slot 670 formed in the inner surface of body portion 684. Bore 688 carries a first 689 end of a shaft 691, the second end 692 of which is rotatably and telescopically received in the bore of hollow pintle member 640 of hinge 560. An enlarged head 693 formed at first end 689 of shaft 691 resides in slot 690 in body portion 684. In addition, shaft 691 includes an enlarged diameter portion 694 intermediate first end 689 and second end 692. Enlarged head 693 and enlarged diameter portion 694 prevent longitudinal movement of shaft 691 relative to body portion 684.

Various other modifications and variations to the embodiments herein chosen for purposes of illustration will readily occur to those skilled in the art. To the extent that such modifications and variations do not depart from the spirit of the invention, they are intended to be included within the scope thereof which is limited only by a fair assessment of the following claims.

Having fully described and disclosed the instant invention in such clear and concise terms as to enable those skilled in the art to understand and practice the same, the invention claimed is:

1. A sectional door assembly comprising:

a) an upper section having a lower longitudinal edge;

b) a lower section having an upper longitudinal edge;

c) hinge means for pivotably securing said lower section to said upper section for rotation about a first longitudinal axis; and d) a guide assembly for affixing said door to a building and allowing reciprocal movement along an upright axis, said guide assembly including i) a tubular guide portion securable to said building, said guide portion including a guiding surface, ii) a guide member including a semi-cylindrical body portion having a guide surface slidably encompassing said guiding surface, and attachment means for securing said body portion to said door, said attachment means having a longitudinal axis coinciding with said first longitudinal axis.

2. A sectional door assembly according to claim 1, wherein said hinge means comprises:

a) an element of an engagement pair secured to one of i) said lower longitudinal edge of said upper section, and ii) said upper longitudinal edge of said lower section; and b) a complemental element of said engagement pair secured to the other of i) said lower longitudinal edge of said upper section, and ii) said upper longitudinal edge of said lower section.

3. A sectional door assembly according to claim 2, wherein:

a) said element includes a pintle; and b) said complemental element includes a socket for rotatably receiving said pintle.

4. A sectional door assembly according to claim 3, wherein:

a) said pintle defines a longitudinally extending bore radially symmetric about said first longitudinal axis; and b) said attachment means comprises a shaft extending from said body portion and received within said bore.

5. A sectional door assembly according to claim 4, wherein said shaft is rotatably and telescopically received within said bore.

6. A sectional door assembly according to claim 2, wherein:

a) said element extends continuously along substantially the entire length of one of said longitudinal edges; and b) said complemental element extends continuously along substantially the entire length of the other of said longitudinal edges.

* * * * *